United States Patent [19]

Darstein et al.

[11] Patent Number: 4,647,323

[45] Date of Patent: Mar. 3, 1987

[54] METHOD AND APPARATUS FOR FORMING CABLE HARNESSES

[75] Inventors: Schuyler R. Darstein; David A. Wedell, both of Winston-Salem, N.C.

[73] Assignee: AMP Incorporated, Harrisburg, Pa.

[21] Appl. No.: 880,647

[22] Filed: Jun. 27, 1986

Related U.S. Application Data

[63] Continuation of Ser. No. 645,949, Aug. 30, 1984, abandoned.

[51] Int. Cl.[4] ..... H01B 13/00

[52] U.S. Cl. ..... 156/50; 29/33 M; 29/857; 156/543; 174/72 A; 174/117 F; 339/28; 339/276 SF

[58] Field of Search ..... 29/33 M, 857; 156/50, 156/543; 174/72 A, 117 F; 339/17 F, 28, 29 R, 276 SF

[56] References Cited

U.S. PATENT DOCUMENTS

| | | | |
|---|---|---|---|
| 3,774,284 | 11/1973 | Cootes | 29/751 |
| 3,836,415 | 9/1974 | Hilderbrandt | 156/181 |
| 3,938,246 | 2/1976 | Over et al. | 29/33 M X |
| 4,110,880 | 9/1978 | Peppler et al. | 29/33 K |
| 4,130,934 | 12/1978 | Asick et al. | 174/117 F X |
| 4,228,709 | 10/1980 | Guzay et al. | 83/620 |
| 4,290,179 | 9/1981 | Bakermans et al. | 29/33 M |
| 4,335,497 | 6/1982 | Casey | 29/753 X |

*Primary Examiner*—Robert A. Dawson

*Attorney, Agent, or Firm*—Katherine A. Nelson; Robert W. Pitts

[57] ABSTRACT

A method and apparatus are disclosed in which an elongate strip of multi-conductor flat flexible cable is fed by feeding means along a predetermined path of travel where it intersects with a pair of spaced apart, elongate strips of terminals. The strips of terminals are arranged with the terminals facing in opposite directions and predetermined lengths thereof are fed by feeding means such that the predetermined lengths of the stripes and the flexible cable are in a superposed relation. Rows of terminals are separated from the strips of terminals and fastened by terminal applicator means to the flexible cable in electrical conductive relation to the conductors therein. This procedure is repeated at predetermined, spaced apart locations along the length of the elongate strip of flexible cable to form interconnected cable harnesses of the cable and terminals. Simultaneously therewith, knife means form at least one weakened tear line in the flexible cable between the rows of terminals so that the interconnected cable harnesses are separable when desired to be used.

26 Claims, 24 Drawing Figures

112
120
121
124
123

117a
126
125
116a
31
30
117
116
113
114
111

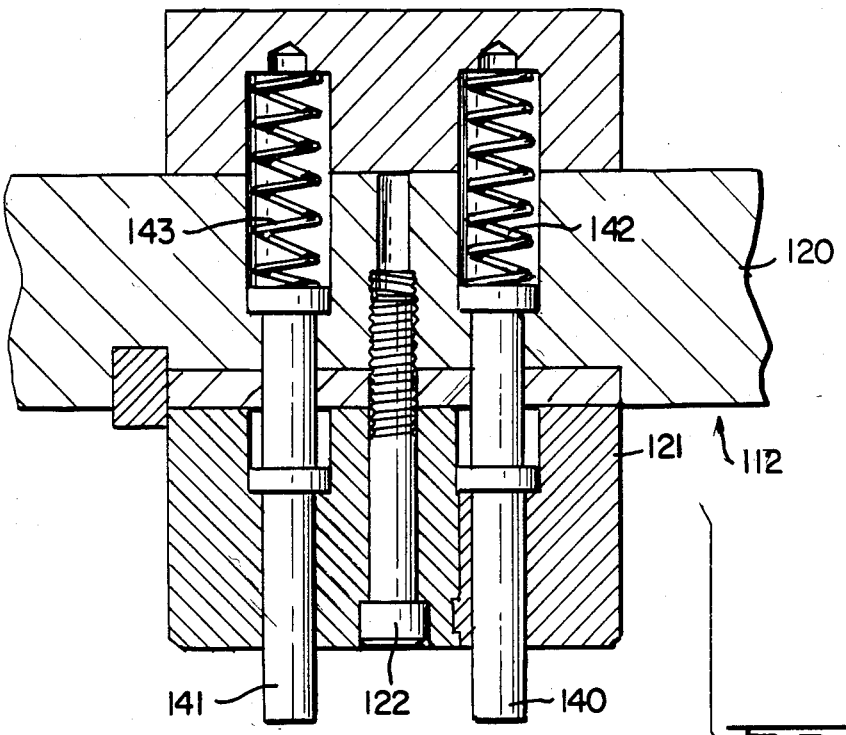
Fig. 6A
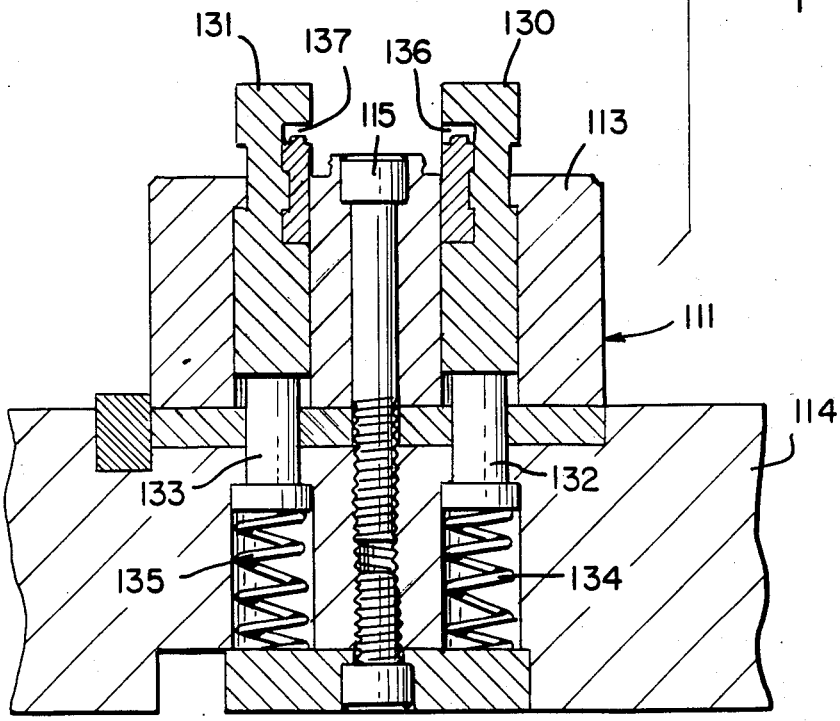

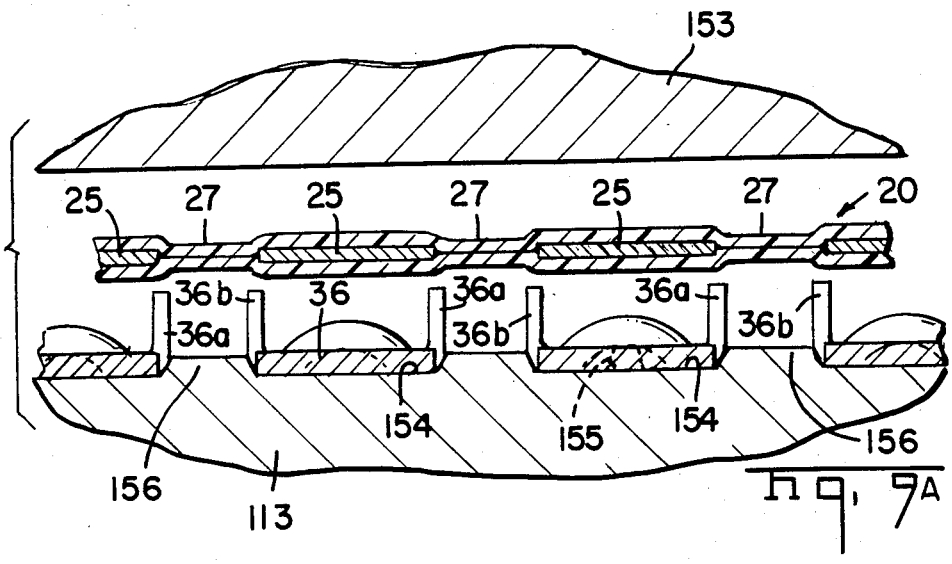
Fig. 9A
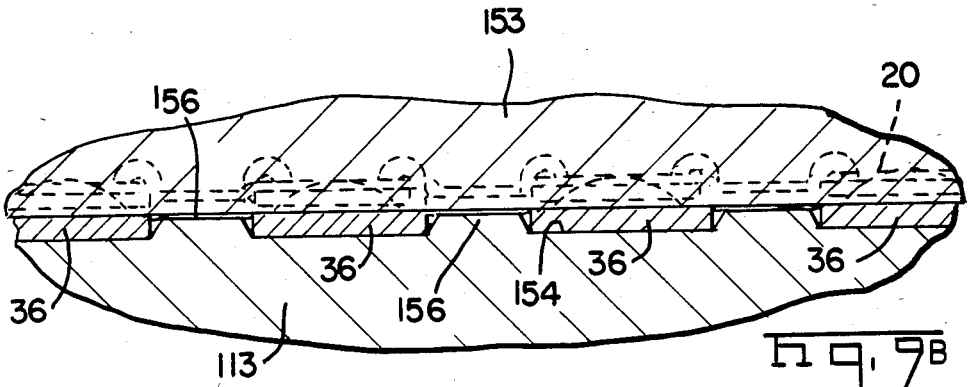
Fig. 9B
Fig. 9C
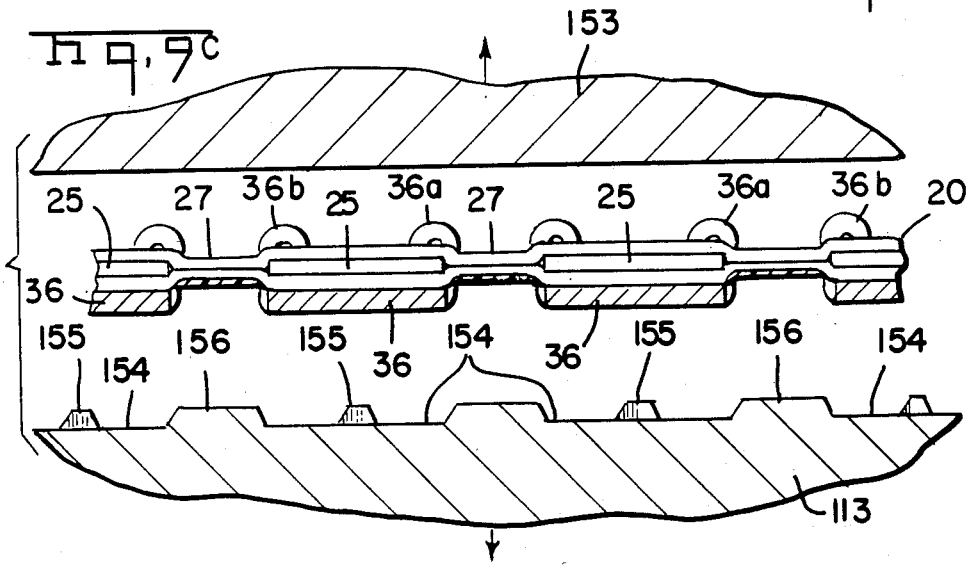

METHOD AND APPARATUS FOR FORMING CABLE HARNESSES

This application is a continuation of application Ser. No. 645,949 filed 8/30/84 and now abandoned.

The present invention relates to the manufacture of cable harnesses from predetermined lengths of multi-conductor flat flexible cable by attachment of terminals to opposite ends of the conductors in the flexible cable, and more particularly to a method and apparatus for forming such cable harnesses in serially interconnected but separable form.

BACKGROUND OF THE INVENTION

Cable harnesses comprising predetermined lengths of multi-conductor flat flexible cable having terminals at opposite ends of each of the conductors thereof are well-known and widely used in the electronics industry for many purposes, such as, for example, connecting printed circuit boards. Heretofore a cable harness was made by severing a predetermined length of the flexible cable from a strip or roll and then applying terminals successively to the ends of the predetermined length of cable. U.S. Pat. Nos. 4,335,497; 4,110,880; and 3,774,284 disclose several different apparatus for forming such cable harnesses.

While successfully forming cable harnesses, such apparatus were not without limitations and deficiencies, among which were that with some apparatus the terminals were applied successively one-at-a-time firstly to one end of the length of cable and secondly to the other end thereof. Even where gang application of terminals is disclosed, the application of the terminals is still accomplished successively to the opposite ends of the length of cable.

U.S. Pat. No. 4,290,179 discloses an apparatus for forming cable harnesses by simultaneously terminating all conductors at one or both ends of a length of cable. While a distinct improvement over previous apparatus, this apparatus still formed individual cable harnesses in loose or unconnected form which present difficulties in handling, packaging and shipping such cable harnesses.

With the foregoing in mind, it is an object of the present invention to provide a method and apparatus for forming cable harnesses from an elongate strip of multi-conductor flat flexible cable which overcomes the deficiencies and difficulties heretofore encountered.

It is a more specific object of the present invention to provide a method and apparatus for forming cable harnesses from an elongate strip of multi-conductor flat flexible cable by gang fastening spaced apart, oppositely facing rows of terminals at predetermined locations along the strip of flexible cable while forming at least one weakened tear line in the cable between the rows of terminals so that the cable harnesses remain interconnected but are separable when desired for use.

SUMMARY OF THE INVENTION

The foregoing objects are accomplished in accordance with the present invention by a method and apparatus in which an elongate strip of multi-conductor flat flexible cable is fed along a predetermined path of travel where it intersects with a pair of spaced apart, elongate strips of terminals. The strips of terminals are arranged with the terminals facing in opposite directions and predetermined lengths thereof are fed into superposed relation to the flexible cable. Rows of terminals are separated from the strips of terminals and fastened to the flexible cable in electrical conductive relation to the conductors therein. This procedure is repeated at predetermined, spaced apart locations along the length of the elongate strip of flexible cable to form interconnected cable harnesses of the cable and terminals. Simultaneously therewith, at least one weakened tear line is formed in the flexible cable between the rows of terminals so that the interconnected cable harnesses are separable when desired to be used.

BRIEF DESCRIPTION OF THE DRAWINGS

Some of the features and advantages of the invention having been briefly stated, others will appear from the detailed description which follows, when taken in connection with the accompanying drawings, in which

FIG. 3 is an enlarged, fragmentary sectional view taken substantially along line 3—3 in FIG. 2;

FIGS. 6A and 6B are enlarged, fragmentary sectional views taken substantially along line 6—6 showing the upper die in the same operative positions as illustrated in FIGS. 5A and 5B, respectively;

FIGS. 9A and 9B are further enlarged and fragmentary sectional views taken substantially along line 9A—9A in FIG. 8A and line 9B—9B in FIG. 8B, and FIG. 9C is a view similar to FIG. 9A but illustrating the upper die being retracted to its upper or open position;

DETAILED DESCRIPTION OF THE INVENTION

Referring now more particularly to the drawings, the preferred embodiment of the method and apparatus of the present invention will now be described. The method and apparatus of the present invention are illustrated schematically in FIG. 1. The method of this invention commences with the step of feeding an elongate strip of multi-conductor flat flexible cable 20 from a suitable source, such as reel 21 (FIG. 2), longitudinally along a predetermined path of travel in intermittent intervals so that a predetermined length of the strip of cable 20 is fed during each feeding interval. This predetermined length of cable 20 is fed by any suitable means, such as by a pair of feed rolls 22, 23 driven by any suitable means, such as a stepping motor 24 (FIG. 2). The drive for rolls 22, 23 is preferably variable so that the length of the flexible cable 20 fed during each feeding interval may be varied to correspond to the desired length of the cable harnesses being formed.

Figure 1:
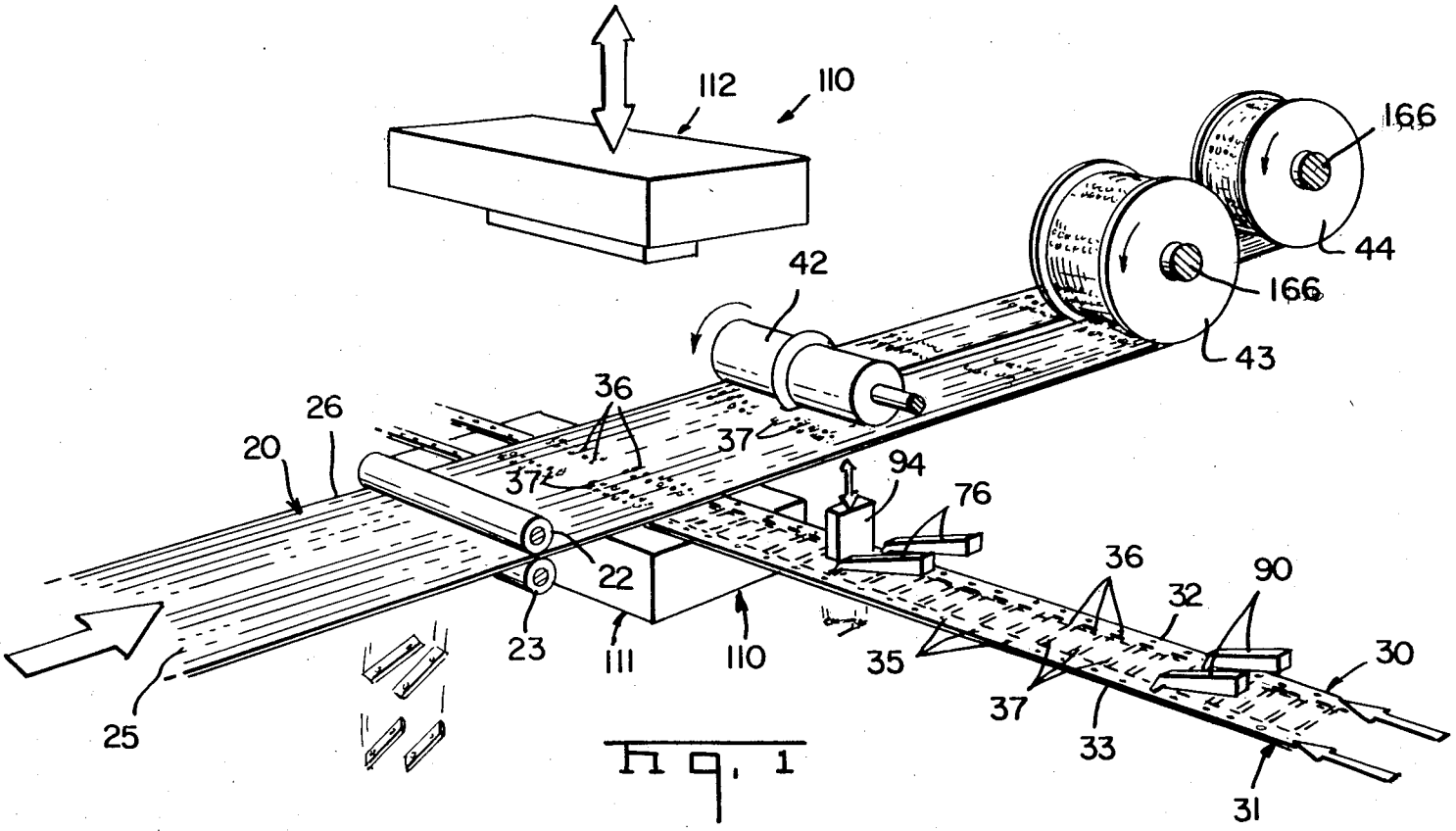
FIG. 1 is a fragmentary perspective view illustrating the method and apparatus of the present invention.
Figure 2:
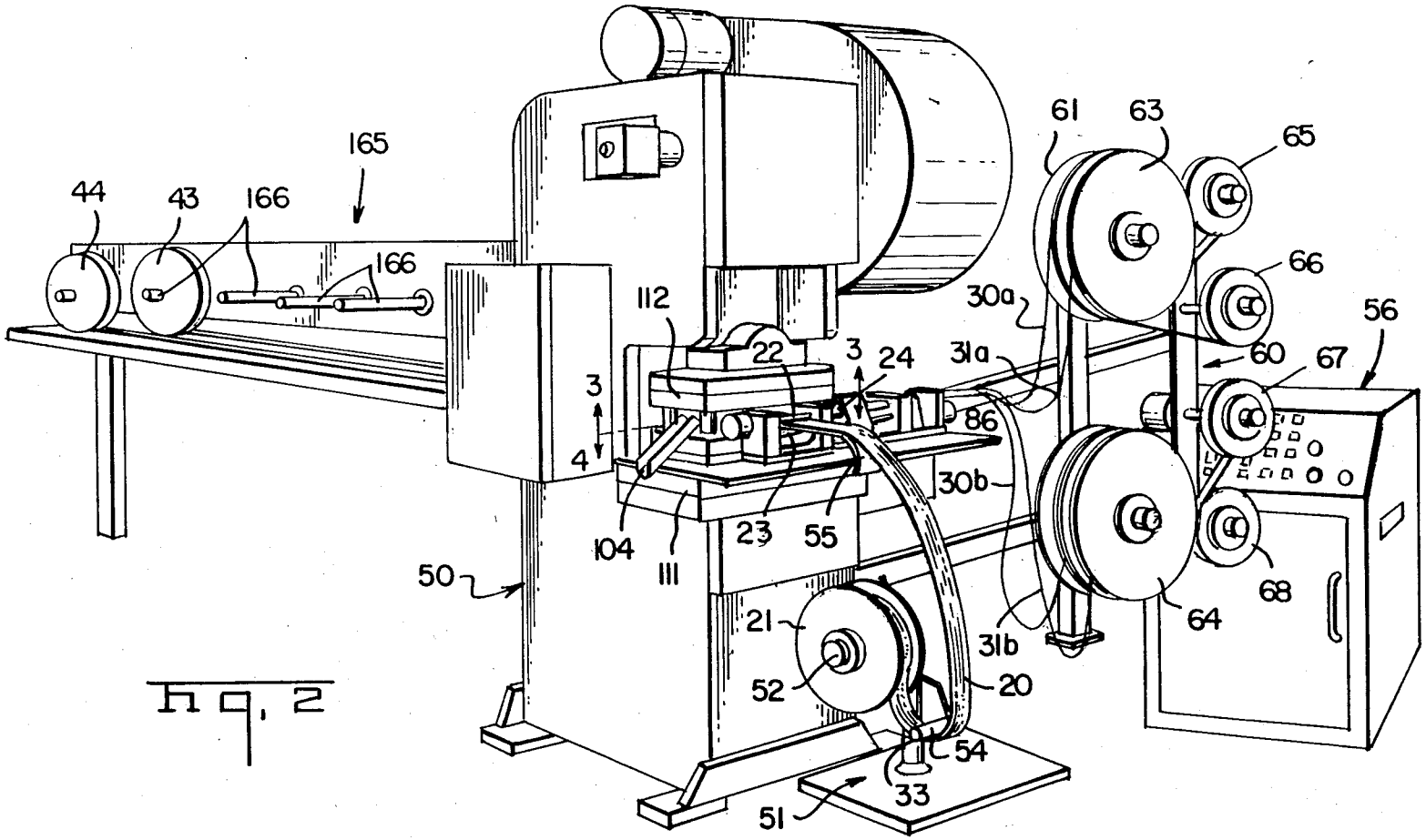
FIG. 2 is a perspective view of an apparatus incorporating the present invention.
Figure 7:
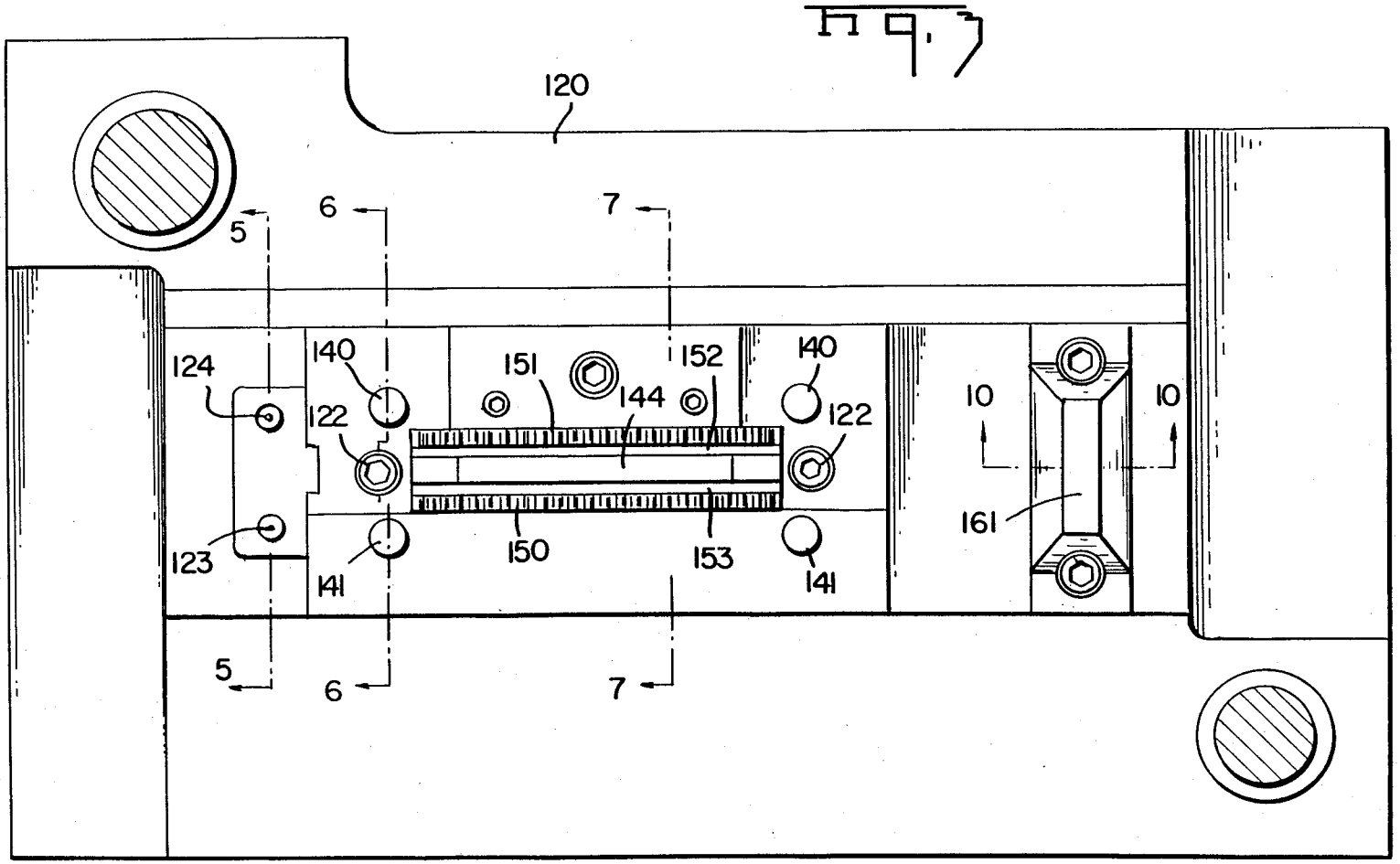
FIGS. 7A and 7B are enlarged, fragmentary sectional views similar to FIGS. 5A and 5B taken substantially along line 7—7 in FIG. 4.
Figure 4:
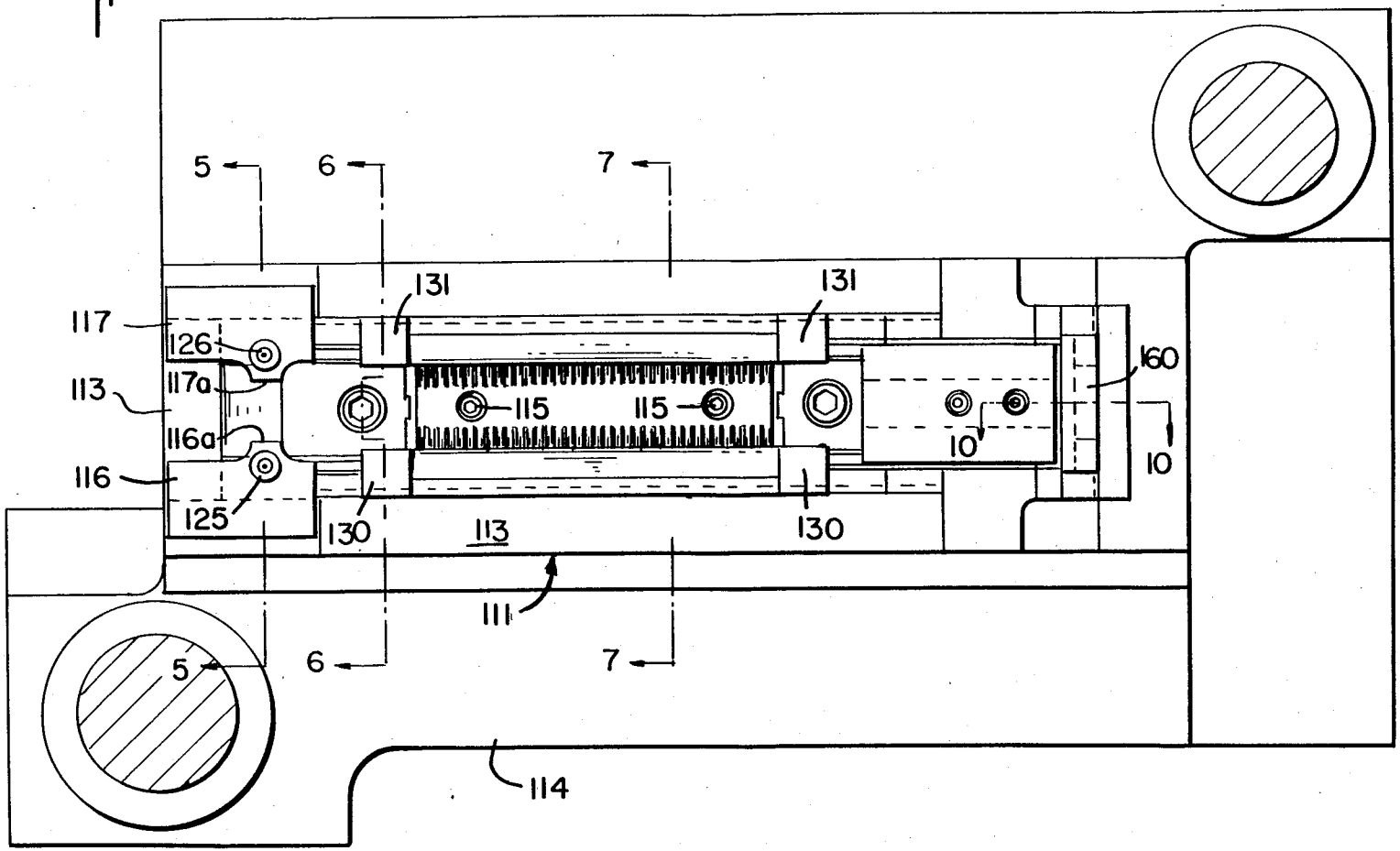
FIG. 4 is an enlarged, fragmentary sectional view taken substantially along line 4—4 in FIG. 2.
Figure 15:
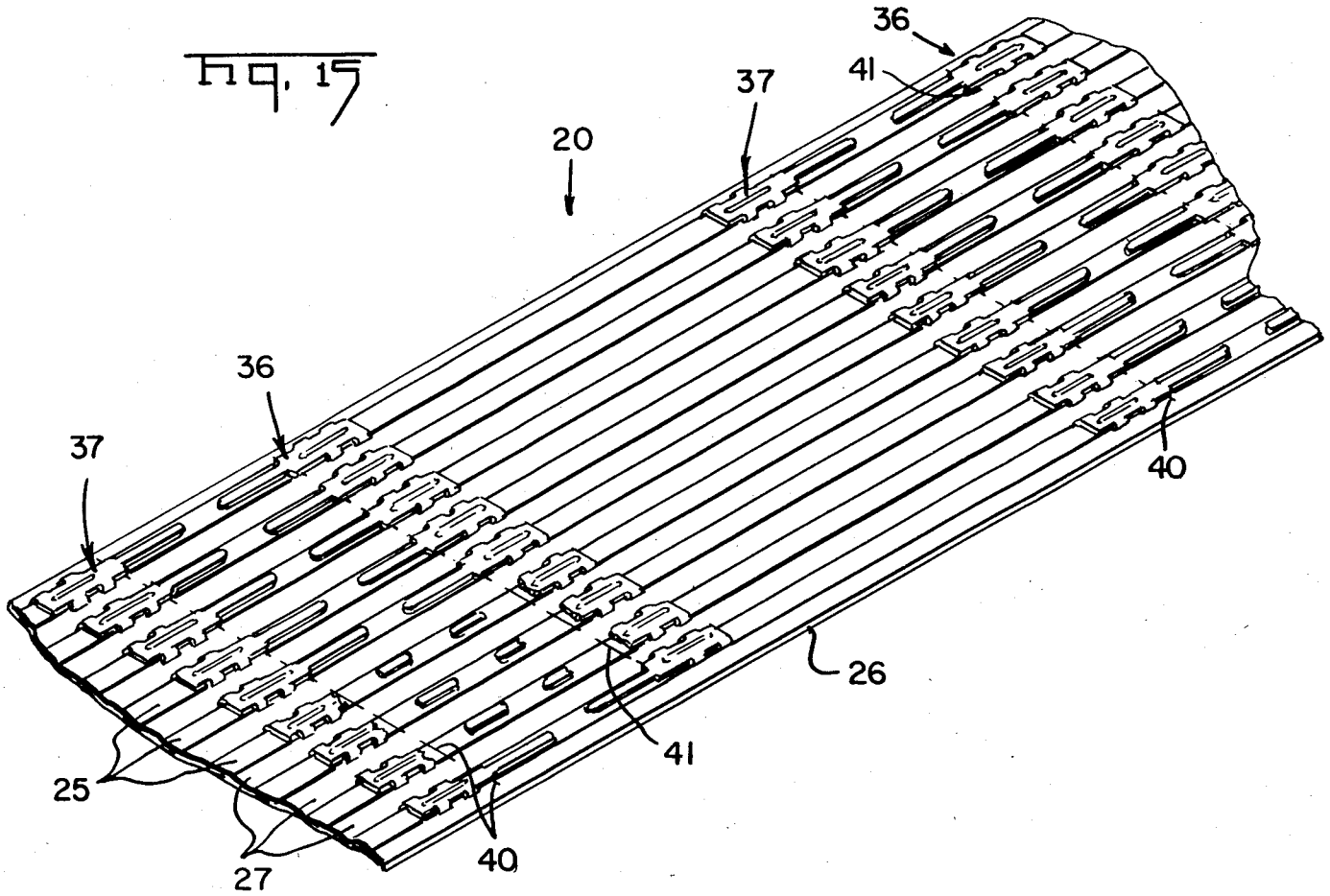
FIG. 15 is an enlarged, fragmentary perspective view of one side of a strip of interconnected but separable cable harnesses formed by the method and apparatus of the present invention.
Figure 16:
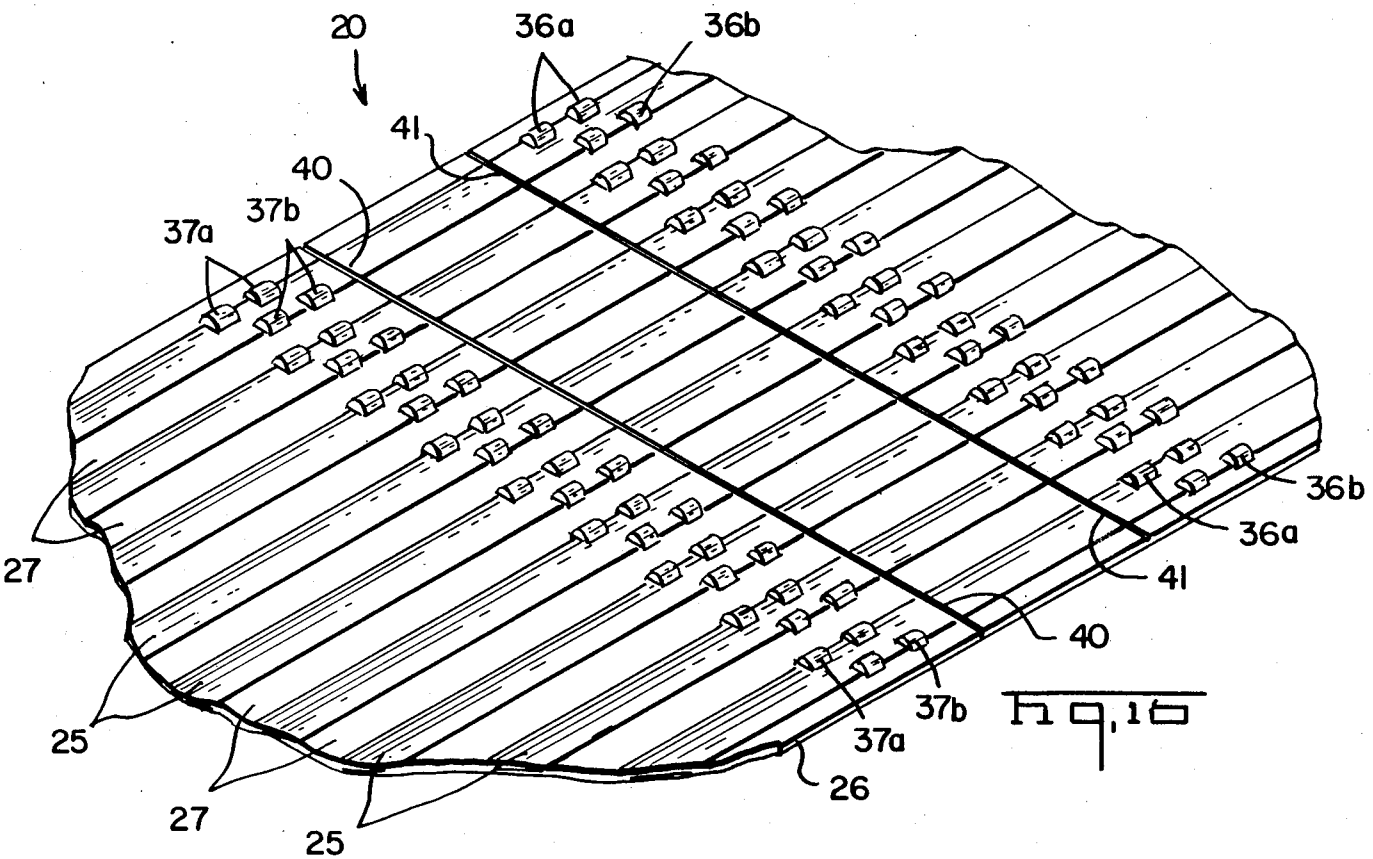
FIG. 16 is a view similar to FIG. 15 of the other side of the strip of cable harnesses shown in FIG. 15.

The strip of flexible cable 20 is well known and includes a plurality of flat elongate conductors 25 encased within an outer sheath 26 (FIGS. 1, 15 and 16). The conductors 25 are spaced apart within sheath 26 so that the conductors 25 are insulated by the intervening portions 27 of the sheath 26 from each other. Flexible cables are supplied with conductors 25 evenly spaced across the width of the cable and, depending upon end use requirements, with one or more conductors omitted so as to provide a blank space or spaces across the width of the cable.

The method of the present invention further includes the step of feeding a pair of elongate, oppositely facing, parallel strips of terminals 30, 31 along spaced apart paths of travel perpendicular to the path of travel of the flexible cable 20 in intermittent intervals and in timed relation to the feeding intervals of cable 20 so that predetermined lengths of the strips of terminals 30, 31 and the flexible cable 20 are in a superposed relation. The strips of terminals 30, 31 include continuous carrier portions 32, 33, respectively, extending along distal sides of the pair of terminal strips 30, 31 and having spaced-apart holes 34, 35 therein for use in feeding the terminal strips 30, 31 and for alignment purposes. Carrier portions 32, 33 have integrally formed therewith and support a plurality of spaced apart terminals 36, 37 which project laterally from carrier portions 32, 33 toward each other in alignment with each other. To achieve closer spacing of the terminals, the strips of terminals 30, 31 comprise two terminal strips **30*a*, 30*b* and 31*a*, 31*b*, respectively, (FIG. 2**) which are stacked in superposed relation as is more fully described in U.S. Pat. No. 4,021,095.

Each of the terminals 36, 37 is integral with its associated carrier portion at one end and extends laterally outwardly therefrom to a point where it terminates in a free end. At an intermediate location along their length but closer to the end supported by the carrier portions, each of the terminals 36, 37 have upwardly projecting pairs of teeth **36*a*, 36*b* and 37*a*, 37*b*, respectively, (FIGS. 8*a* and 9*a*) on opposite sides thereof for penetration through the flexible cable 20 to establish an electrical conductive relation to the conductors 25. The teeth 36*a*, 36*b* and 37*a*, 37*b* of terminals 36, 37 are adapted to be crimped after penetrating through the cable 20 to fasten the terminals onto the cable 20 (FIGS. 9A, 9B and 9C**). U.S. Pat. No. 4,082,402 discloses such terminals and their manner of connection to flexible cable in more detail and reference is made thereto for such greater detail.

Once the pair of terminal strips 30, 31 are fed into position underneath the flexible cable 20, the terminals 36, 37 are aligned with conductors 25 and define opposing, spaced apart rows of terminals. The terminals 36, 37 are then removed from the carrier portions 32, 33 and the teeth **36*a*, 36*b* and 37*a*, 37*b* are caused to penetrate through the cable 20 and are crimped on the opposite side thereof (FIGS. 9A, 9B, 9C, 15 and 16). This procedure is repeated for each feeding interval to form interconnected cable harnesses with terminals 36, 37 at opposite ends of the predetermined lengths of cable 20**.

At the same time, at least one weakened tear line is formed across flexible cable 20 between the rows of terminals 36, 37 such that the interconnected cable harnesses may be separated from each other for use. Preferably, a pair of weakened tear lines 40, 41 (FIG. 16) are formed between the rows of terminals 36, 37, with the tear lines 40, 41 being located between the portions of the terminals 36, 37 crimped to the cable 20 and the free ends of the terminals. Weakened tear lines 40, 41 are preferably formed by severing the conductors 25 and the portions of the sheath 26 overlying and underlying those conductors and by scoring the portions 27 of the sheath 26 lying between the conductors 25.

If cable 20 is of the type with one or more conductors omitted to form cable harnesses narrower than the width of cable 20, then appropriate pairs of terminals 36, 37 are removed from the pair of terminal strips 30, 31 at a location or locations which will underlie the location or locations of the omitted conductors prior to the terminal strips 30, 31 being fed into underlying relation to the cable 20. The cable 20 with spaced rows of terminals 36, 37 may be longitudinally slit as generally indicated at 42 (FIG. 1) along the space or spaces provided by an omitted conductor or conductors to form multiple narrower strips of interconnected cable harnesses.

Finally, the completed strip or strips of interconnected but separable cable harnesses are preferably wound into rolls on suitable take-up reels 43, 44. The rolls of interconnected cable harnesses may be stored, packaged and shipped in this compacted form with the attendent advantages of savings in space, shipping costs and ease of handling, and also with the advantage that the terminals are protected from damage since the projecting tips thereof lie along and are protected by the portion of cable lying between the weakened tear lines 40, 41. When the cable harnesses are desired for use, individual cable harnesses may be removed from a roll of the strip of harnesses by tearing along the tear lines 40, 41. The portion of cable 20 between adjacent tear lines 40, 41 will be discarded since it has served its functions of interconnecting the cable harnesses and protecting the projecting tips of the terminals 36, 37.

The apparatus of the present invention will now be described in greater detail, some elements thereof having been previously described generally in describing the method of the present invention. While the apparatus of this invention may take many forms, it is illustrated in the drawings as a modified punch press 50 (FIG. 2). Apparatus 50 includes the usual structural frame, housing and drive mechanisms of conventional punch presses which are well known and need not be described here.

Apparatus 50 does include suitable supporting structure 51 for cable supply reel 21 including a shaft 52 on which reel 21 is supported and a standard 53. Reel 21 may be positively driven or free wheeling with a suitable brake in a manner not shown. Supporting structure 51 includes a guide 54 for guiding cable 20 from reel 21 to a guide plate 55 which supports cable 20 as it is fed into apparatus 50 by feed rolls 22, 23.

As described previously, feed rolls 22, 23 are driven intermittently by stepping motor 24 to feed predetermined lengths of cable 20 for fastening of terminals thereto. Stepping motor 24 is computer controlled by control means 56 in a manner well known to those skilled in the art to vary the length of cable 20 fed into apparatus 50 as desired and thereby to vary the length of cable harnesses being formed.

Apparatus 50 includes a creel 60 (FIG. 2) for supporting supply reels 61, 62 and 63, 64 for strips of terminals 30*a*, 30*b* and 31*a*, 31*b*, respectively. The supply reels 61, 62, 63 and 64 are preferably driven in a manner (not shown) to avoid undue tension on the strips of terminals being withdrawn therefrom. The convolutions of the strips of terminals 30*a*, 30*b* and 31*a*, 31*b* on reels 61–64 are separated by divider strips which are wound on take-up reels 65, 66, 67 and 68 as the terminal strips 30*a*, 30*b* and 31*a*, 31*b* are unwound from reels 61–64.

The strips of terminals 30*a*, 30*b* and 31*a*, 31*b* are directed from supply reels 61–64 to a feed track 70 (FIGS. 11 and 12) and the strips 30*a* and 30*b* and strips 31*a* and 31*b* are brought into superposed or stacked relation with the individual terminals off-set in the manner previously described. Two pairs of guide rolls 71*a*, 71*b* and 72*a*, 72*b* are provided at the input end of feed track 70 to guide, control and tension the strips of terminals 30, 31.

Figure 13:
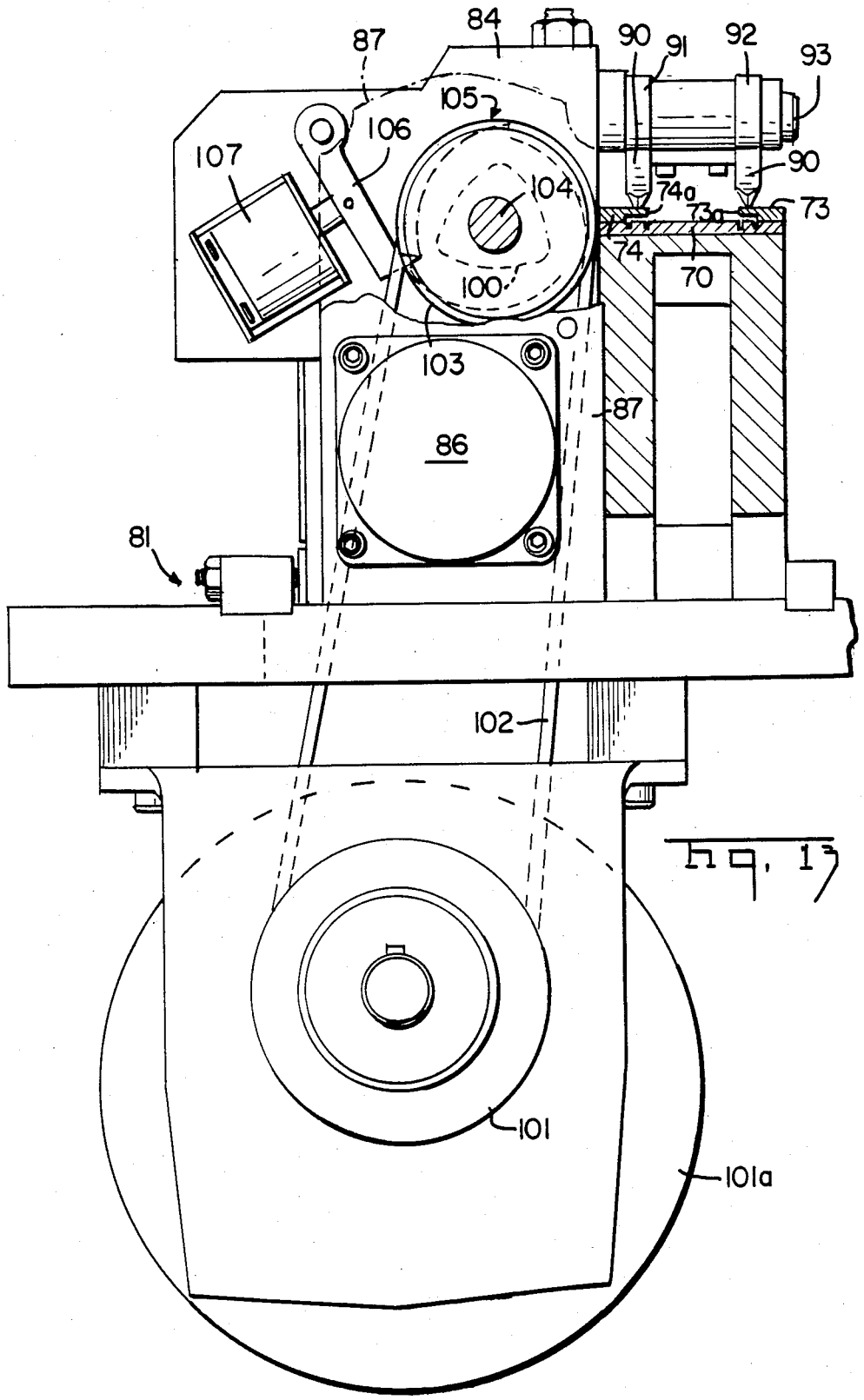
FIG. 13 is an enlarged vertical sectional view taken substantially along line 13—13 in FIG. 12.

Strip guides 73, 74 are provided along opposite sides of feed track 70 and included overhanging guide portions 73*a*, 74*a* spaced upwardly from feed track 70 for receipt of the carrier portions 32, 33 of terminal strips 30, 31 therebeneath (FIG. 13). The overhanging guide portions 73*a*, 74*a* are cut away or foreshortened approximately midway of feed track 70 to expose carrier portions 32, 33 and particularly the holes 34, 35 therethrough (FIG. 2).

Feeding means 75 is provided for intermittently feeding terminal strips 30, 31 into apparatus 50. Feeding means 75 includes a pair of feeding fingers or pawls 76 which are carried by a bushing 77 journaled on a stub shaft 78. Feeding fingers 76 are biased downwardly toward feed track 70 and have the lower ends thereof sharpened so that they will enter holes 34, 35 in carrier portions 32, 33 of terminal strips 30, 31.

Shaft 78 is carried by a slide 80 slideably mounted on a supporting frame 81 (FIGS. 11, 12, 14*a* and 14*b*. Slide 80 is moved by a screw 82 journaled at its opposite ends in supports 83, 84 of frame 81 and connected to the output shaft 85 of a reversible stepping motor 86 mounted on a support 87 of frame 81. Slide 80 includes a threaded portion which mates with the threads of screw 82 such that when screw 82 is rotated by stepping motor 86, slide 80 is moved therealong in a direction determined by the direction of rotation of screw 82.

Figure 11:
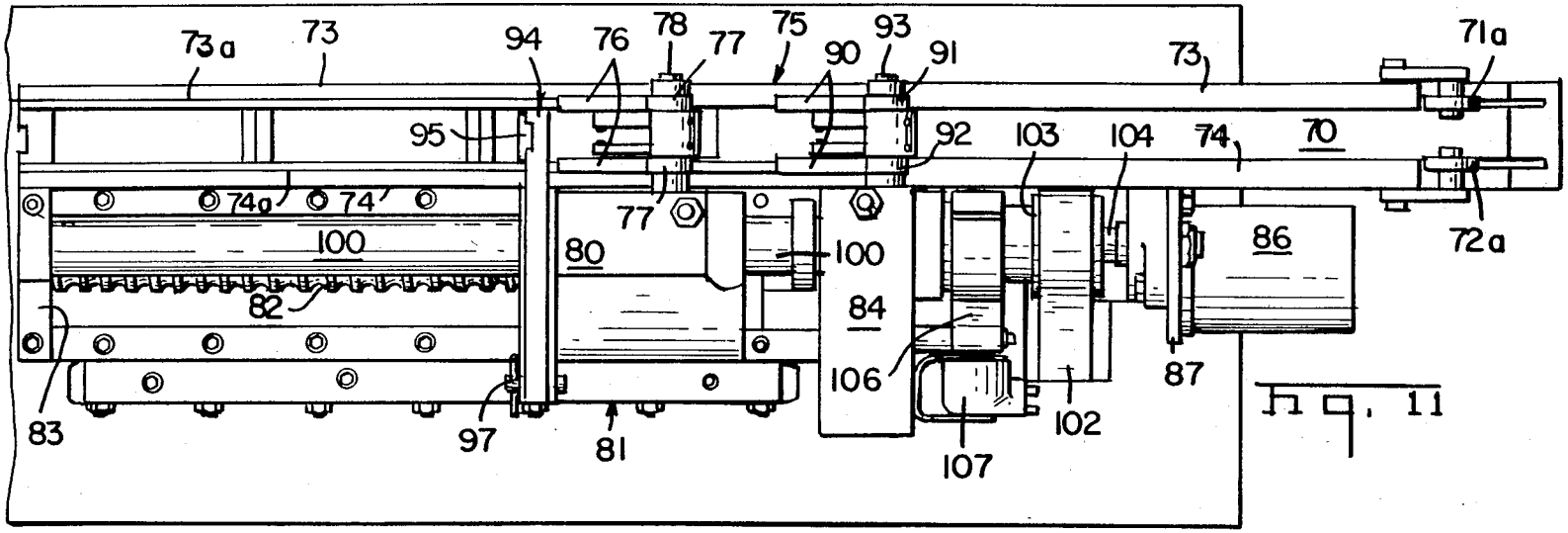
FIG. 11 is an enlarged top plan view of the terminal strip feeding means and excess terminal removal means shown in the right hand medial portion of FIG. 2.
Figure 12:
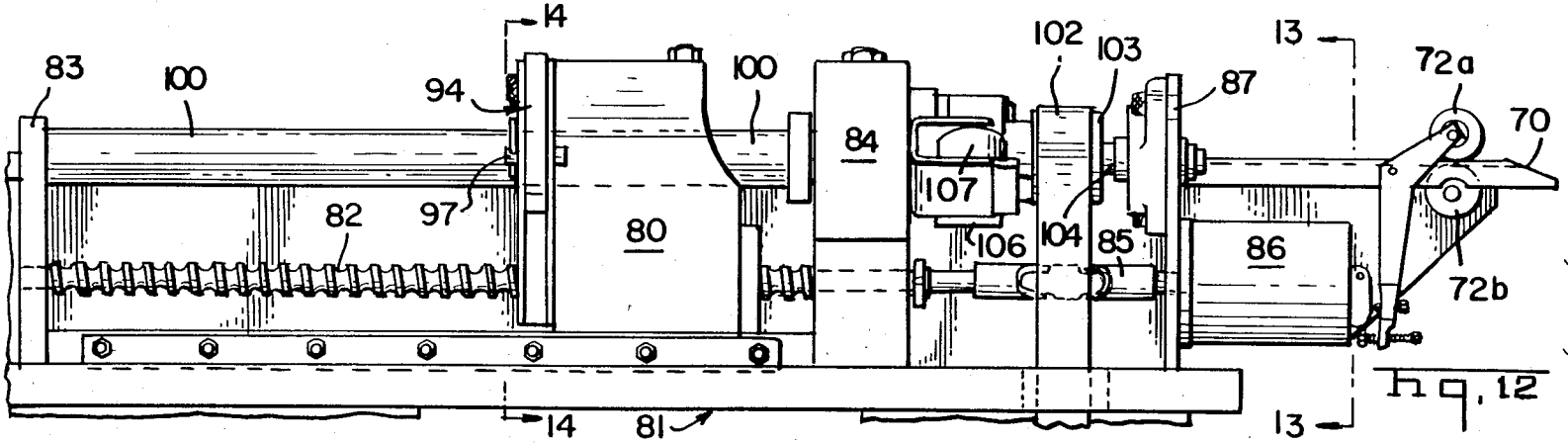
FIG. 12 is a front elevation of the apparatus shown in FIG. 11.

Rotation of screw 82 in one direction moves the slide 80 to the right as seen in FIGS. 11 and 12 and this movement may be characterized as the inactive or retractive stroke of feeding means 75. A pair of anti-back-up fingers or pawls 90 are carried by bushings 91, 92 journaled on a stub shaft 93 carried by support 84 (FIGS. 11 and 13). Anti-back-up fingers 90 are constructed and operate similarly to feeding fingers 76 except that they do not move along feed track 70. Anti-back-up fingers 90 serve to prevent the terminal strips 30, 31 from moving backwards (to the right in FIGS. 11 and 12) during the inactive or retractive stroke of feeding means 75, but ratchet during the active or feeding stroke thereof to permit the terminal strips 30, 31 to move forwardly (to the left in FIGS. 11 and 12).

Stepping motor 86 is suitably controlled by control means 56 to vary the time intervals that screw 82 is rotated during the retractive stroke of feeding means 75 to vary the length of terminal strips 30, 31 fed into aparatus 50, but slide 80 is preferably always returned to the same position at the end of the feeding stroke of feeding means 75. Control means 56 is programmed by the operator with certain data including the width of cable 20 being fed into apparatus 50 and the number and location of any conductors omitted therefrom. This data is then utilized by control means 56 to control feeding means 75 such that the length of terminal strips 30, 31 fed into apparatus 50 corresponds to the width of cable 20.

Further, if any conductors have been omitted from cable 20, corresponding pairs of terminals 36, 37 must be removed from terminal strips 30, 31 before such strips are fed into position for the terminals to be fastened to the cable 20. Terminal removing means 94 is provided for this purpose and is operatively associated with feeding means 75. Terminal removing means 94 includes a plunger or notcher 95 which is located immediately downstream of feeding fingers 76 (to the left in FIGS. 1, 11 and 12). Plunger 95 normally occupies an inactive or retracted position spaced above feed track 70 and terminal strips 30, 31, but is moved downwardly when positioned above a pair of terminals 36, 37 to be removed to sever those terminals from their respective carrier portions 32, 33, which terminals then drop downwardly between the spaced members 70*a*, 70*b* of feed track 70 (FIGS. 14*a* and 14*b*).

Plunger 95 is carried by one end of a cam follower 96 which is pivotally mounted at its other end on slide 80 (FIGS. 11 and 12) by a pin 97. Accordingly, plunger 95 moves along feed track 70 with slide 80.

Figure 14A:
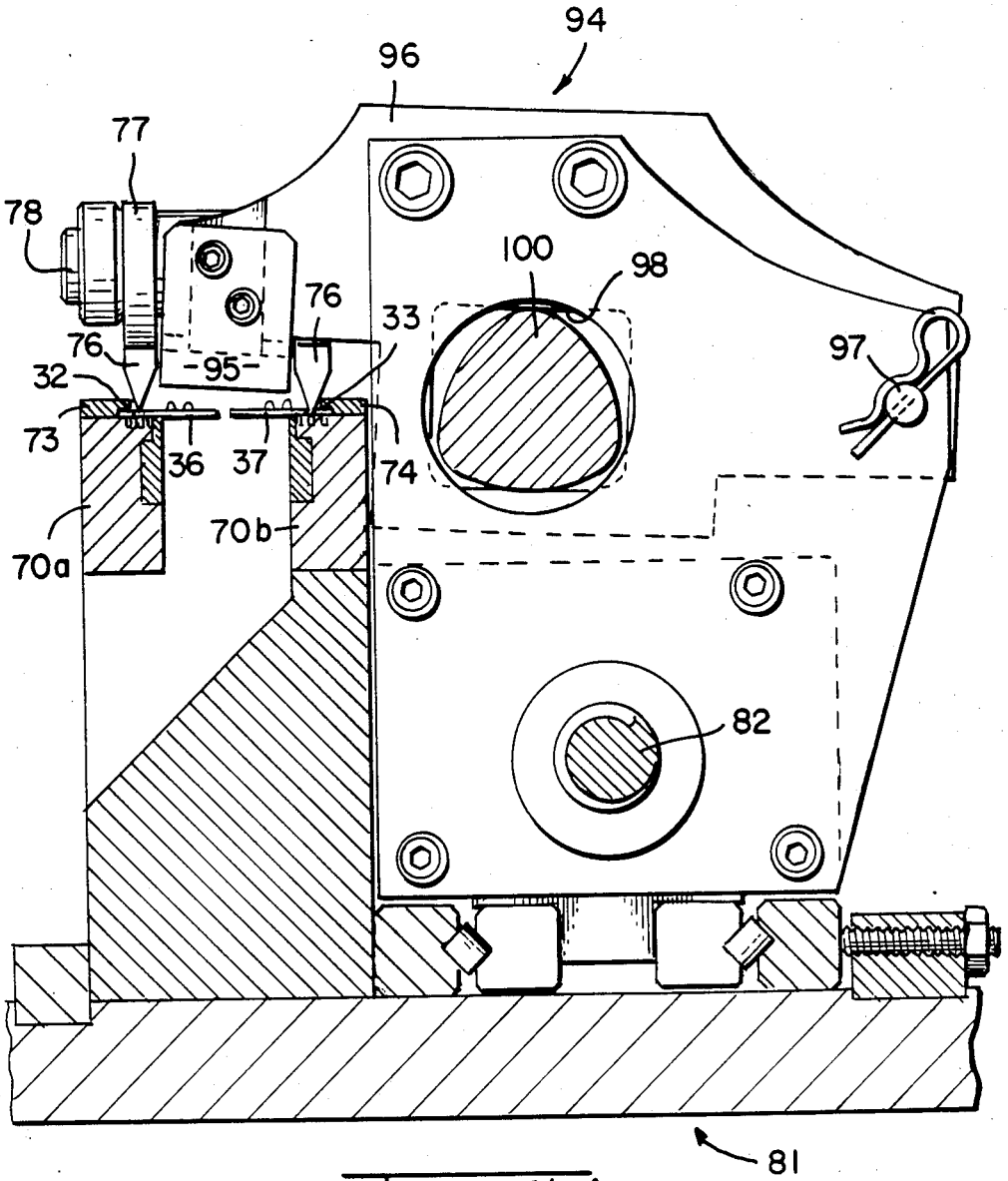
FIGS. 14A and 14B are enlarged sectional views taken substantially along line 14—14 in FIG. 12 and illustrating the excess terminal removal means in different operational positions.
Figure 14B:
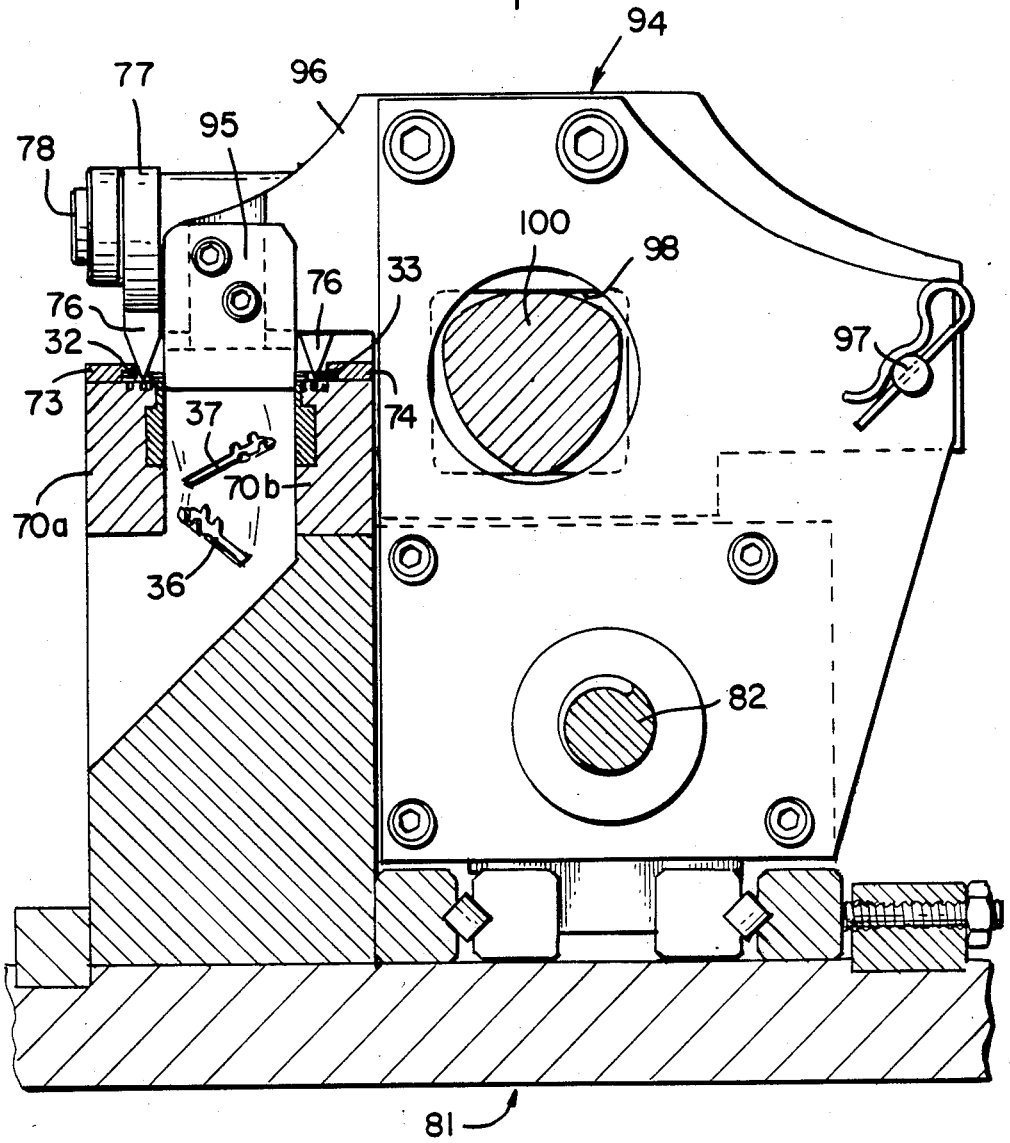

Cam follower 96 has a square hole or opening 98 through which penetrates an elongate cam 100 of generally triangular cross-section so as to have three lobes thereon (FIGS. 14*a* and 14*b*). Cam 100 is journaled for rotation in supports 83 and 84. Drive means is provided for cam 100 which includes a drive pulley 101 (FIG. 13) suitably driven by a motor 10*a*. Drive pulley 101 drives a belt 102 which in turn rotates a driven pulley 103 mounted on a drive shaft 104 which is journaled in support 87.

One half of a slip clutch 105 is mounted on drive shaft 104 and the other half thereof is mounted on cam 100. A pawl 106 cooperates with the half of clutch 105 mounted on cam 100 to normally prevent rotation thereof and to maintain cam 100 stationary. When it is desired to rotate cam 100, a solenoid 107 is momentarily activated and pawl 106 is temporarily withdrawn. This permits clutch 105 to rotate cam 100 for a fraction of a rotation. There are three teeth on the gear with which pawl 106 cooperates, one for each lobe on cam 100. Therefore, cam 100 is rotated one-third of a revolution each time solenoid 107 is momentarily activated and cam follower 96 is pivoted downwardly. Plunger 95 is thus moved downwardly to remove a pair of terminals 36, 37 from the strips 30, 31.

Stepping motor 86 and solenoid 107 are controlled by control means 56 which uses the programmed data about the width of cable 20 and the number and location of omitted conductors to rotate screw 82 to move the slide 80 in its retractive stroke. The retractive stroke of slide 80 is interrupted at a location or locations corresponding to the location or locations of omitted conductors and solenoid 107 is momentarily activated during each such interruption. The retractive stroke of slide 80 is completed when it has moved a length corresponding to the width of cable 20, and is then moved forward by counterrotation of screw 82 by stepping motor 86 to feed a corresponding length of terminal strips 30, 31 into position for fastening of terminals 36, 37 to cable 20.

Figure 5A:
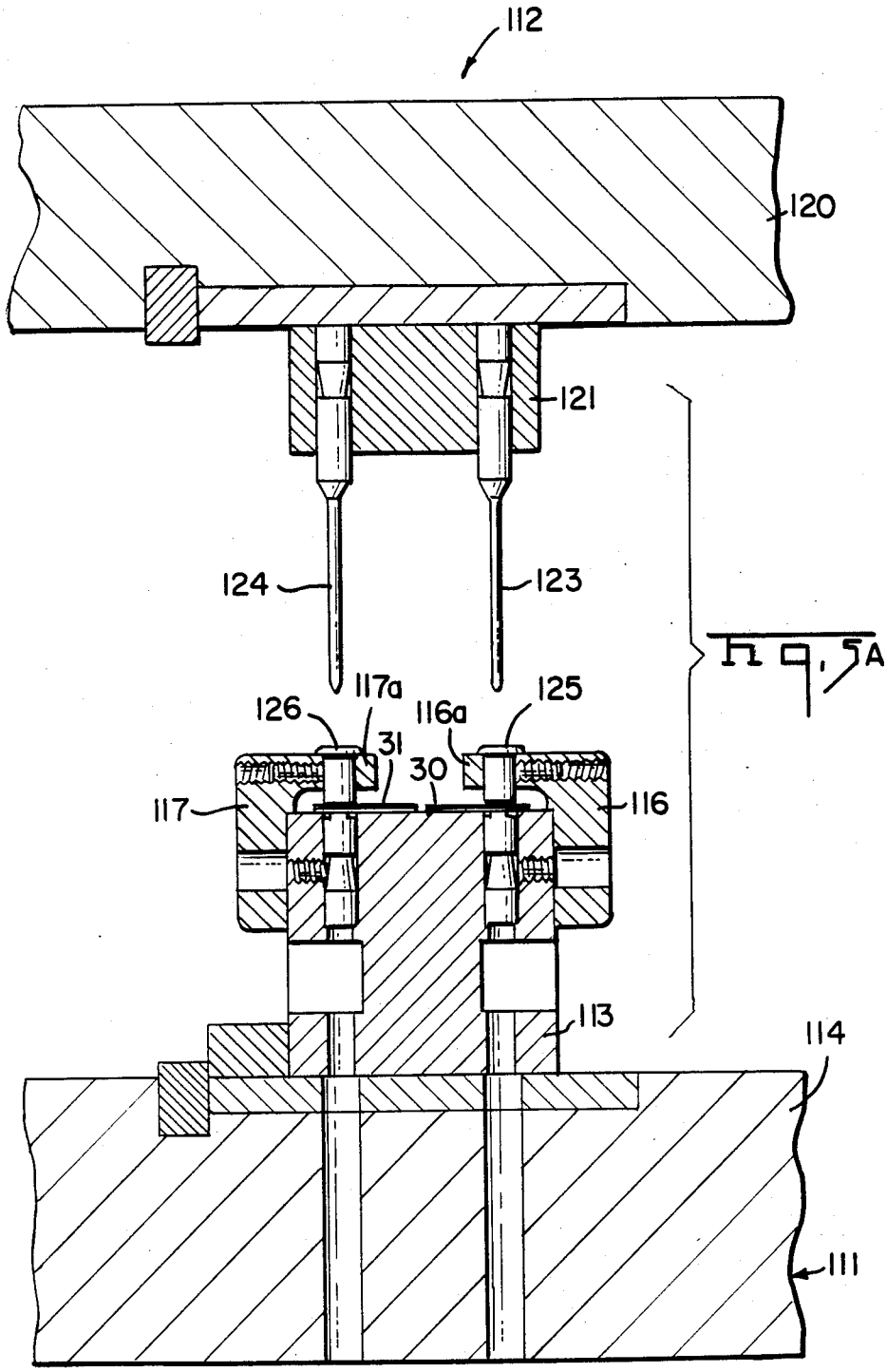
FIGS. 5A and 5B are enlarged, fragmentary sectional views taken substantialy along line 5—5 in FIG. 4, with FIG. 5A illustrating the upper die in its upper or open position and FIG. 5B illustrating the upper die in its lower or closed position.
Figure 5B:
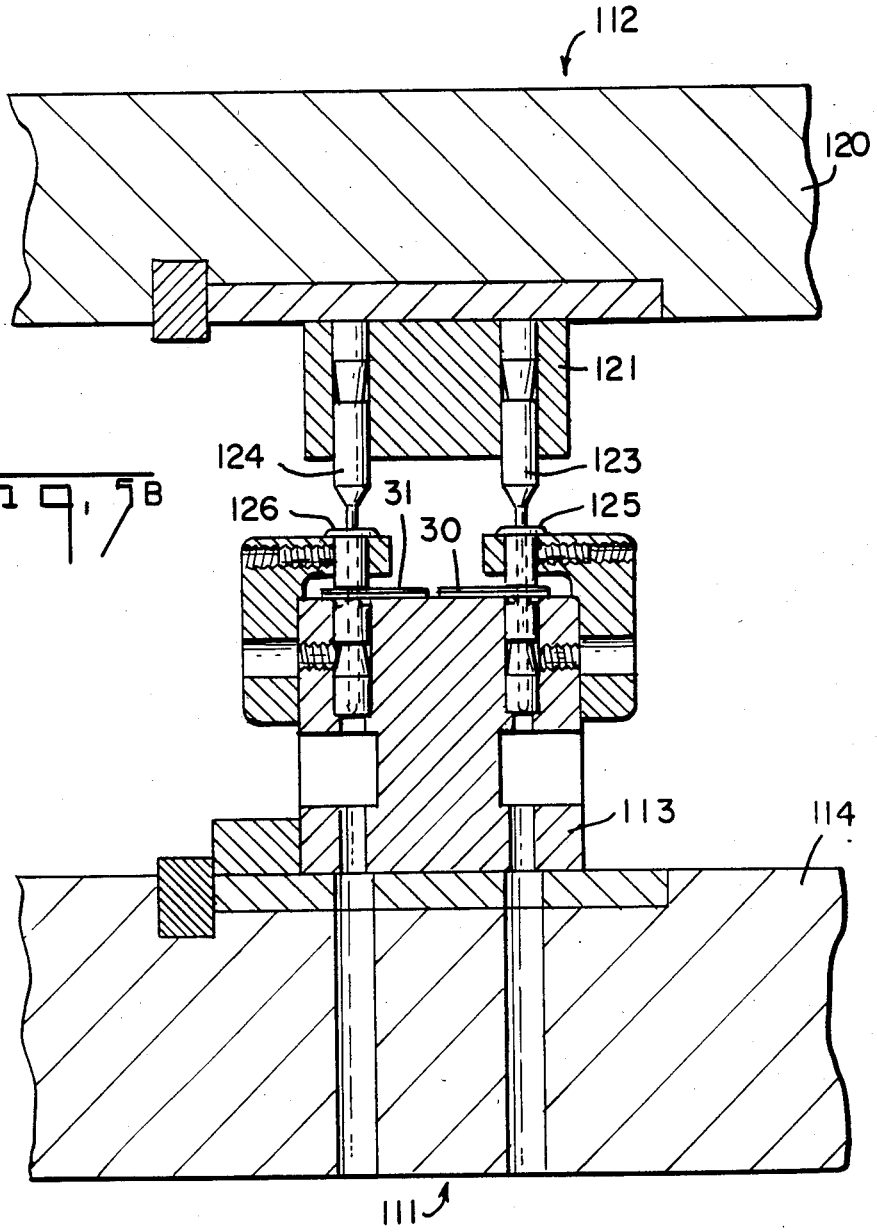
Figure 6B:
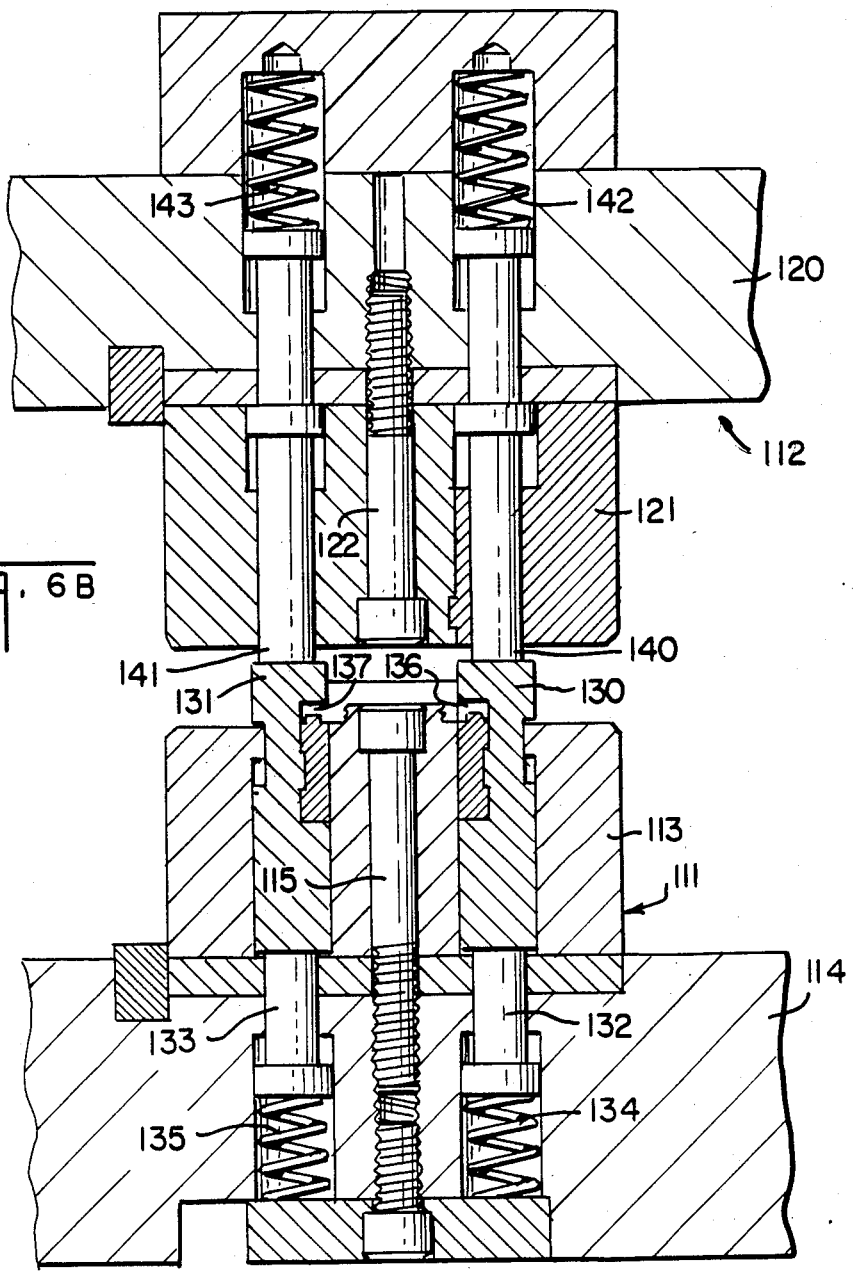

The terminals are fastened to cable 20 in electrical conductive relation to the conductors 25 by fastening means 110 which includes a lower die 111 and an upper die 112 (FIG. 1). Lower die 111 includes an anvil 113 (FIGS. 5A–10B) which supports the terminal strips 30, 31 and terminals 36, 37 once they are removed from the carrier portions 32, 33. Anvil 113 is secured to a base 114 by bolts 115 (FIGS. 6A and 6B). Anvil 113 carries a pair of guides 116, 117 which include overhanging portions **116*a*, 117*a* which receive carrier portions 32, 33 therebeneath to guide terminal strips 30, 31 into position on anvil 113** (FIGS. 5A and 5B).

Upper die 112 includes a base 120 which moves up and down and to which an upper die shoe 121 is attached by bolts 122 (FIGS. 6A and 6B). Upper die shoe 121 carries a pair of positioning pins 123, 124 (FIGS. 5A and 5B) which cooperate with a pair of guide bushings 125, 126 carried respectively by guides 116, 117 to position terminal strips 30, 31 so that the terminals 36, 37 are properly aligned with the conductors 25. As upper die 112 moves downwardly, positioning pins 123, 124 first enter the upper portions of bushings 125, 126 and then penetrate through holes 34, 35 in carrier portions 32, 33, of terminal strips 30, 31. The pins then move into the lower portions of the bushings 125, 126 and hold the carrier portions 32, 33 firmly during the fastening operation.

Figure 8A:
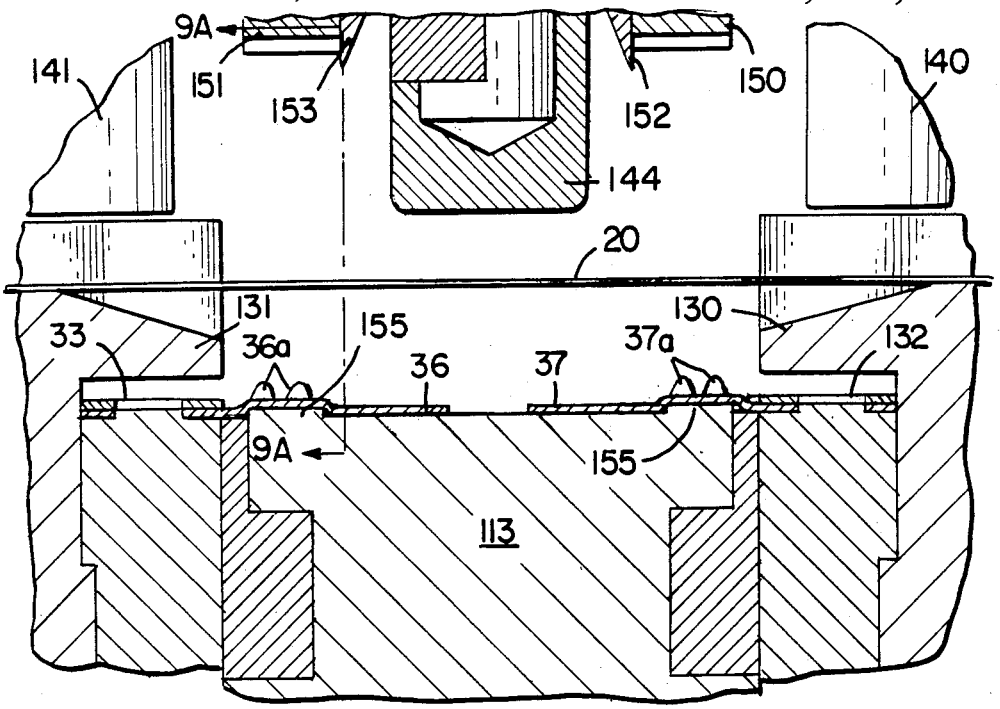
FIGS. 8A and 8B are views similar to FIGS. 7A and 7B, respectively, but further enlarged and even more fragmentary and illustrating the upper die and lower die in operation.
Figure 8B:
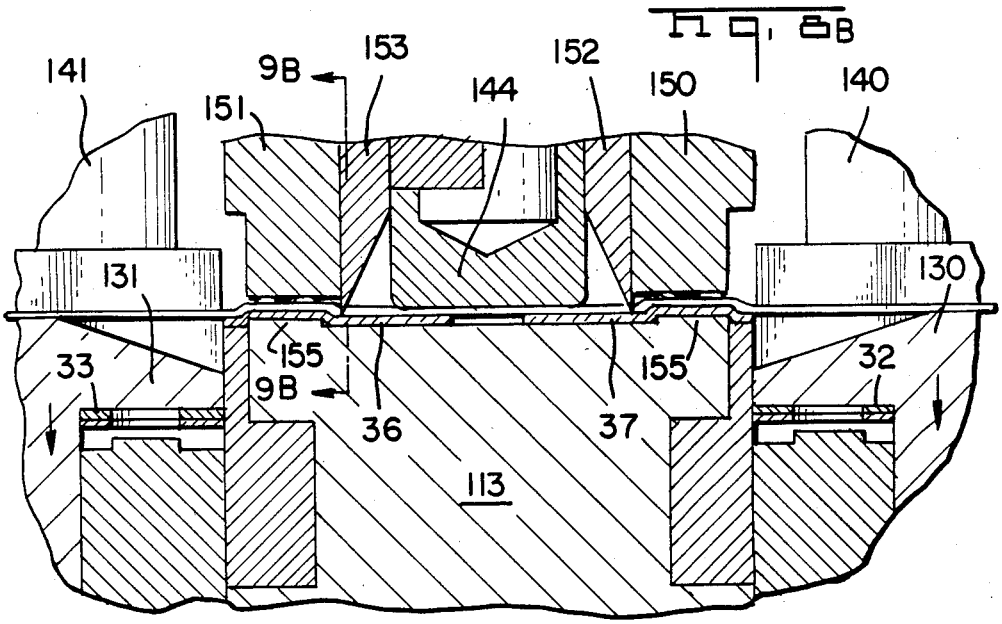
Figures 10A, 10B:
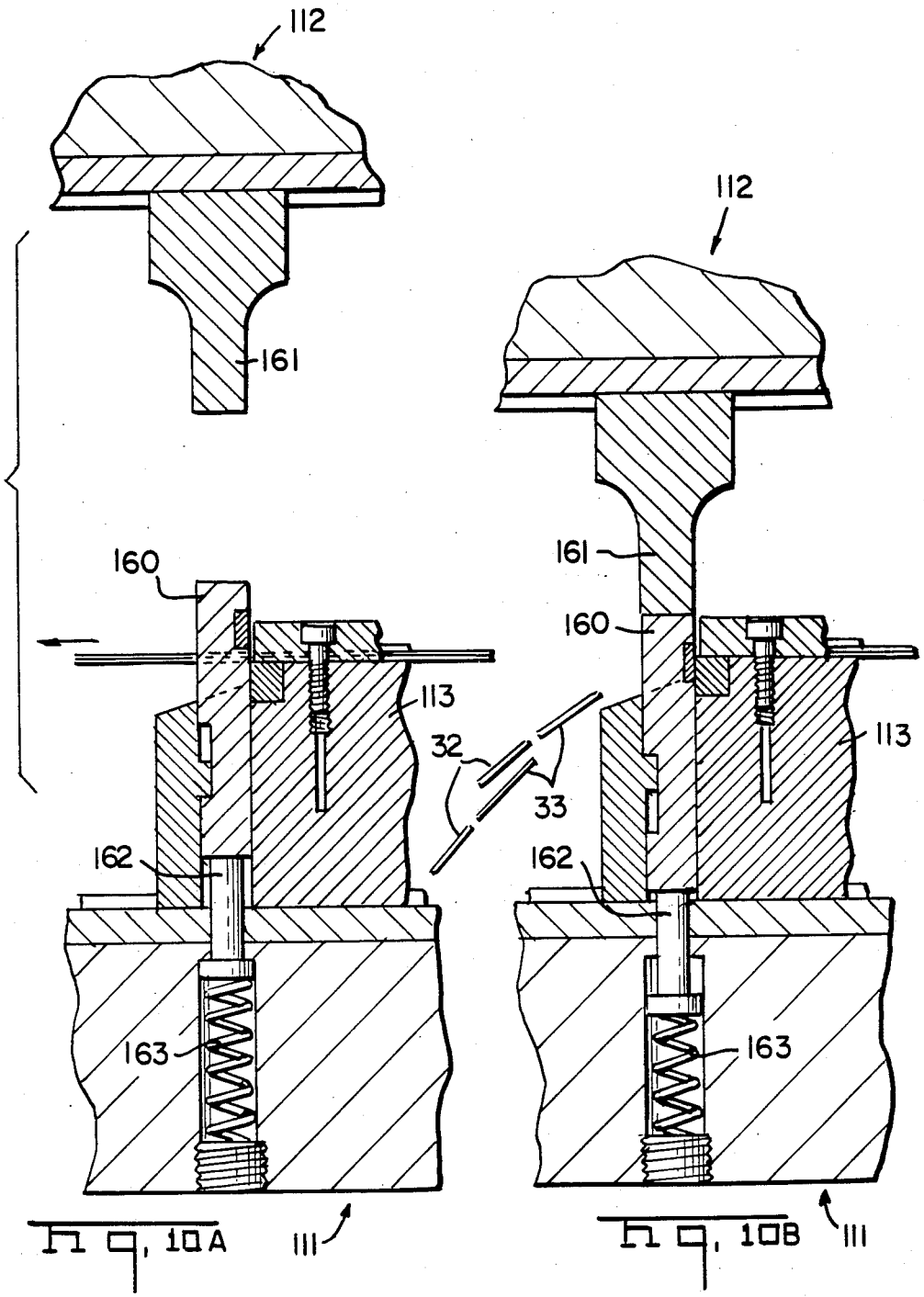
FIGS. 10A and 10B are enlarged, fragmentary sectional views taken substantially along line 10—10 in FIG. 4 and illustrating the upper die in open and closed positions, respectively.

Terminal removing means is provided for removing the two rows of terminals 36, 37 to be fastened to cable 20 from carrier portions 32, 33. This means includes a pair of cutter members 130, 131 carried by anvil 113 for limited vertical movement by mounting pins 132, 133 slideably mounted in base 114 (FIGS. 6A and 6B). Compression springs 134, 135 positioned in base 114 beneath mounting pins 132, 133 bias cutter members 130, 131 upwardly. Cutter members 130, 131 have carrier portion receiving slots 136, 137 in the upper portion thereof which receive the carrier portions 32, 33 therein with the terminals 36, 37 projecting outwardly toward each other. Cutter members 130, 131 cooperate with anvil 113 to sever the projecting terminals 36, 37 from carrier portions 32, 33 in a scissors-like manner upon downward movement of the cutter members 130, 131 (FIGS. 8A and 8B).

Cutter members 130, 131 are moved downwardly upon downward movement of upper die 112 by actuating pins 140, 141 mounted in upper die shoe 121 and base 120 for limited vertical movement. Compression springs 142, 143 are positioned above actuating pins 140, 141 to bias these pins downwardly. Compression springs 142, 143 have an initial stronger resistance to compression than do compression springs 134, 135 which bias cutter members 130, 131 upwardly so that when actuating pins 140, 141 contact the tops of cutter members 130, 131 they will be moved downwardly and compress springs 134, 135. Once cutter members 130, 131 have moved downwardly far enough to sever the terminals 36, 37 from carrier portions 32, 33, springs 134, 135 will have been compressed to the point where their resistance to further compression will exceed that of springs 142, 143 and actuating pins 140, 141 will then retract within upper die shoe 121 upon further downward movement of upper die 112 (FIG. 6B).

Figure 7A:
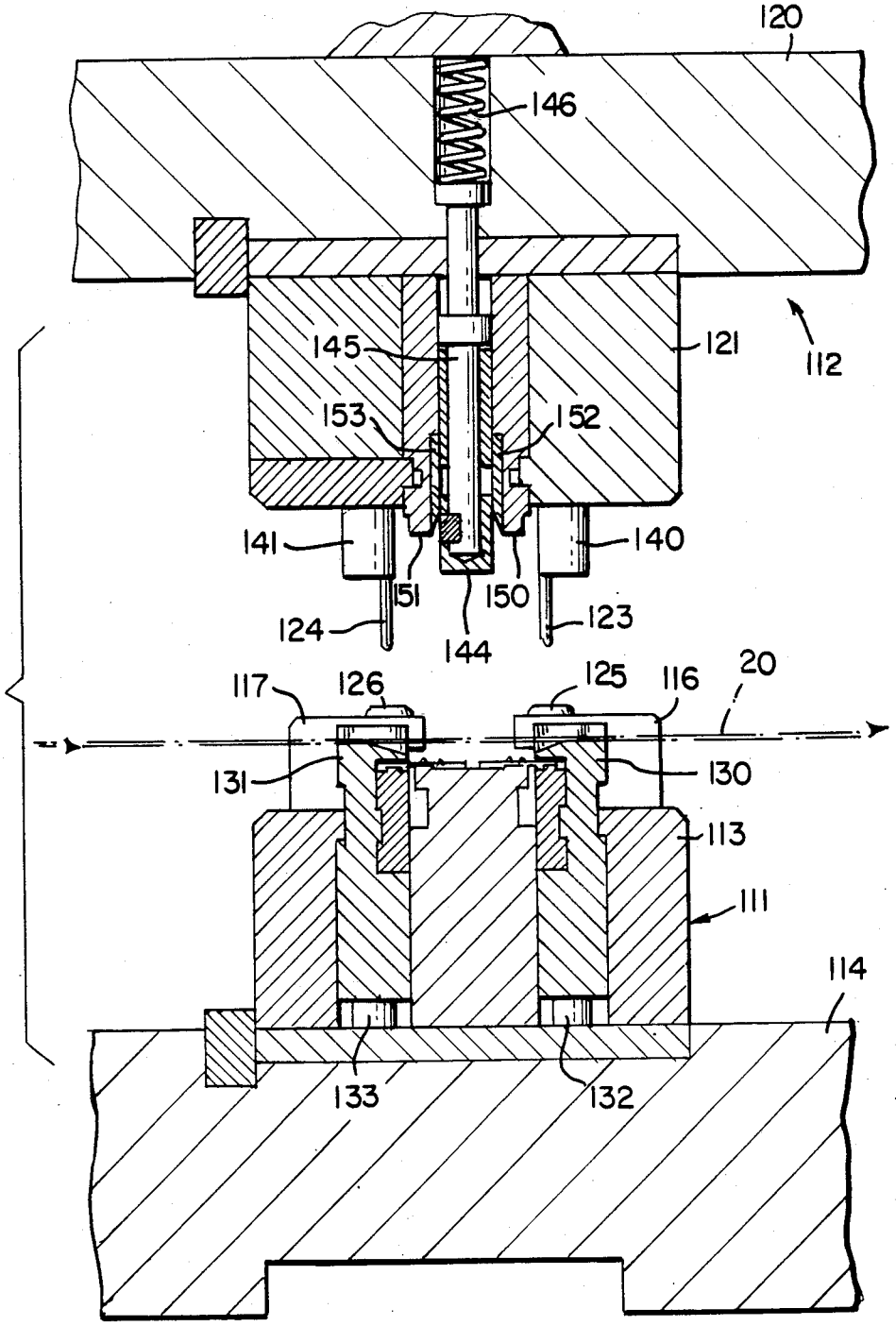
Figure 7B:
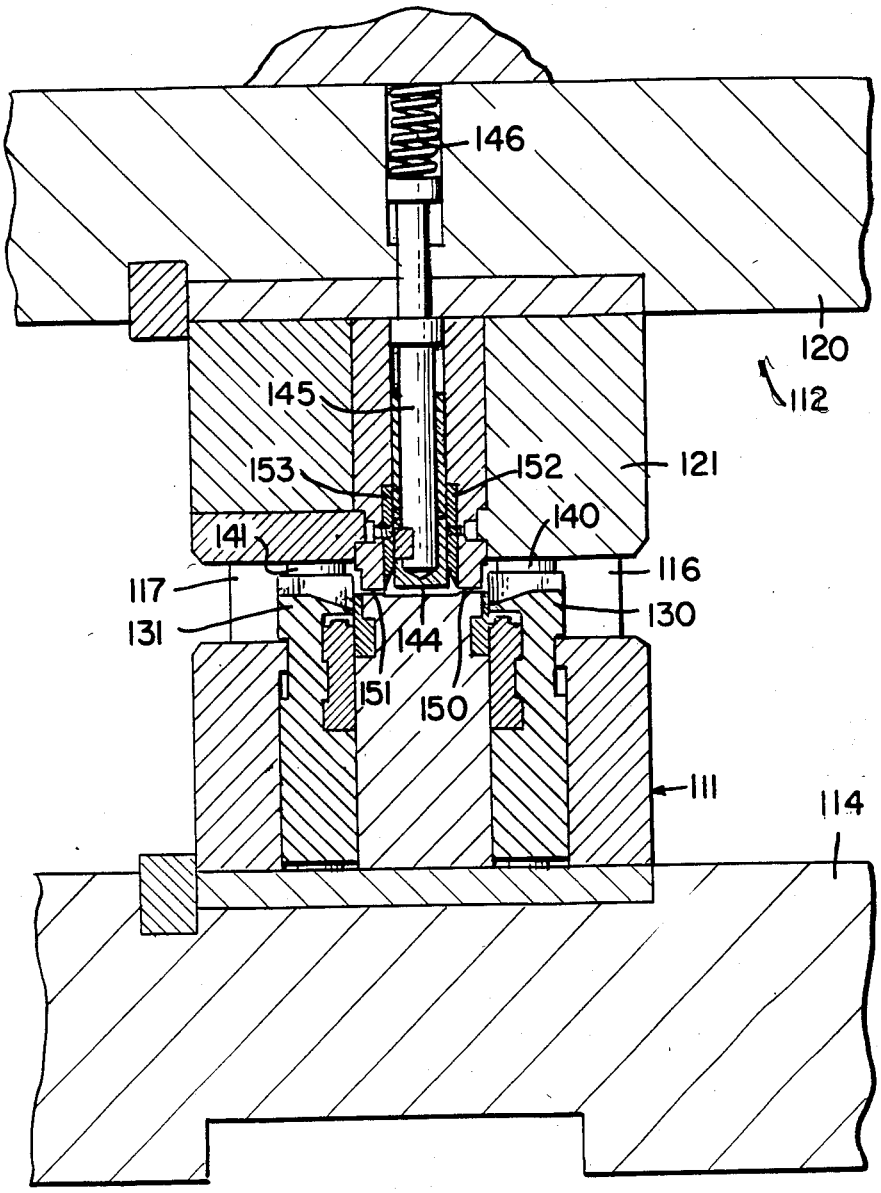

Upper die 112 also includes a clamping member 144 mounted on upper die shoe 121 by mounting pins 145 (only one of which is shown in FIGS. 7A and 7B) which are mounted for limited vertical movement in upper die shoe 121 and base 120. A compression spring 146 is positioned above each mounting pin to bias clamping member 144 downwardly while allowing the limited vertical movement thereof. Upon downward movement of upper die 112, clamping member 144 moves cable 20 downwardly onto the spaced rows of terminals 36, 37 and clamps the cable 20 and terminals 36, 37 against anvil 113 (FIGS. 8A and 8B). At the same time, teeth **36*a*, 37*a* on terminals 36, 37 are caused to at least partially penetrate through cable 20 on opposite sides of conductors 25** but in contact therewith.

Further downward movement of upper die 112 causes clamping member 144 to retract into upper die shoe 121 and brings a pair of crimping members 150, 151 carried by upper die shoe 121 on opposite sides of clamping member 144 into contact with cable 20 and teeth **36*a*, 37*a* on terminals 36, 37. Crimping members 150, 151 have the lower surfaces thereof configured similar to gear teeth with the projecting portions contacting the cable 20 between the terminals 36, 37 and the cavities receiving the teeth 36*a*, 37*a* and crimping them over and onto the upper surface of cable 20** (FIG. 9C).

At the same time, a pair of knives 152, 153 carried by upper die shoe 121 between clamping member 144 and crimping members 150, 151 contact cable 20 and form the weakened tear lines 40, 41 therein (FIGS. 8A–9C). Anvil 113 has cavities 154 in its upper surface which receive the terminals 36, 37 therein (FIGS. 9A–9C). Each cavity 154 has an anchoring stud 155 therein which is received in a groove in the lower surface of each terminal 36, 37 to anchor the terminal in position during fastening to the cable 20. The protions 156 of the upper surface of anvil 113 between cavities 154 have a height slightly less than the thickness of terminals 36, 37.

Accordingly, when knives 152, 153 move downwardly and contact cable 20, the knives 152, 153 continue downwardly until they contact the terminals 36, 37, thereby severing the conductors 25 completely. Since the portions 156 of anvil 113 are spaced slightly below the upper surface of terminals 36, 37, the portions of cable 20 between the terminals 36, 37 are partially but not completely severed (FIGS. 9A–9C). This completes the fastening of the terminals to the cable 20 and the formation of the weakened tear lines 40, 41 and upper die 112 can now be retracted upwardly to its inactive position preparatory to the initiation of the next cycle.

To dispose of the carrier portions 32, 33 once the terminals 36, 37 have been removed therefrom, carrier portion severing means is provided in the form of a cutter member 160 (FIGS. 10A and 10B) carried by anvil 113 and an actuating member 161 carried by upper die 112. Cutter member 160 is mounted for limited vertical movement by mounting pin 162 and a compression spring 163 is positioned beneath pin 162 to bias cutter member 160 upwardly. Cutter member 160 has an opening therethrough to receive carrier portions 32, 33 and, upon being moved downwardly by actuating member 161 as upper die 112 moves downwardly, shears off portions of the carrier portions 32, 33 which drop into a chute 164 (FIG. 2) and thence into a waste receptacle (not shown).

Finally, apparatus 50 includes take-up means 165 which includes spindles 166 for mounting reels 43, 44 for winding the strip or strips of interconnected cable harnesses into rolls (FIG. 2). Spindles 166 are driven intermittently in a manner not shown to rotate take-up reels 43, 44 in timed relation to the feed rolls 22, 23 which feed cable 20. Any desired number of spindles 166 may be used depending upon the number of strips of cable harnesses being formed. Similarly, slitter 42 will have as many blades as there are omitted conductors and is also driven in a manner not shown.

In the drawings and specification, there have been set forth preferred embodiments of the invention, and although specific terms are employed, they are used in a generic and descriptive sense only and not for purposes of limitation.

That which is claimed is:

1. A method of forming serially interconnected cable harnesses from multi-conductor flat flexible cable comprising the steps of (a) feeding an elongate strip of multi-conductor flat flexible cable longitudinally along a predetermined path of travel in intermittent intervals so that a predetermined length of the strip of cable is fed during each feeding interval, (b) feeding a pair of elongate, oppositely facing strips of terminals longitudinally along spaced apart paths of travel perpendicular to the path of travel of the flexible cable in intermittent intervals and in timed relation to the feeding intervals of the flexible cable so that predetermined lengths of the strips of terminals and the flexible cable are in a superposed relation and the terminals of the strips define spaced apart, oppositely facing, transversely extending rows of terminals, and (c) fastening the terminals to the flexible cable in electrical conductive relation to the conductors in the cable in timed relation to the feeding intervals for the flexible cable and strips of terminals whereby a strip of serially interconnected cable harnesses having oppositely facing rows of terminals at opposite ends of predetermined lengths of the flexible cable is formed.

2. A method according to claim 1 wherein each of the strips of terminals include a continuous carrier portion extending along at least one side of the strip and a row of spaced apart, elongate terminals carried by said carrier portion at one end and projecting laterally outwardly from said carrier portion, and wherein the step of fastening the terminals to the flexible cable includes separating the rows of terminals from their respective carrier portions.

3. A method according to claim 2 wherein the step of feeding the strips of terminals is done in such manner that the carrier portions of the strips are on the distal sides of the pair of strips of terminals and the terminals are on the adjacent sides of the pair of strips and thereby project toward each other.

4. A method according to claim 3 wherein the spacing between the paths of travel along which the strips of terminals are fed is small when compared to the predetermined length of the flexible cable fed during each feeding interval.

5. A method of forming serially interconnected but separable cable harnesses from multi-conductor flat flexible cable comprising the steps of (a) feeding an elongate strip of multi-conductor flat flexible cable longitudinally along a predetermined path of travel in intermittent intervals so that a predetermined length of the strip of cable is fed during each feeding interval, (b) feeding a pair of elongate strips of terminals longitudinally along spaced apart paths of travel perpendicular to the path of travel of the flexible cable in intermittent intervals and in timed relation to the feeding intervals of the flexible cable so that predetermined lengths of the strips of terminals and the flexible cable are in a superposed relation, the strips of terminals each including transversely extending, spaced apart, elongate terminals, the strips being fed in such manner that the terminals of the strips define spaced apart, transversely extending rows of terminals in which the terminals of said rows face toward each other, (c) fastening the terminals to the flexible cable in electrical conductive relation to the conductors in the cable in timed relation to the feeding intervals for the flexible cable and strips of terminals, and (d) forming at least one weakened tear line in the strip of flexible cable between and parallel to the rows of terminals formed by the pair of oppositely facing strips of terminals, whereby a strip of serially interconnected but separable cable harnesses having oppositely facing rows of terminals at opposite ends of predetermined lengths of the flexible cable is formed.

6. A method according to claim 5 wherein the step of forming at least one weakened tear line comprises forming a pair of parallel, spaced apart weakened tear lines in the flexible cable with a weakened tear line being formed adjacent each row of terminals so that a section of flexible cable between the rows of terminals is removed when individual cable harnesses are separated from the strip of interconnected cable harnesses.

7. A method according to claim 6 wherein each of the terminals is fastened to the flexible cable at one end portion thereof and has the other end portion free of securement, and wherein the weakened tear lines are formed in the flexible cable between the points of fastening of the terminals in each row of terminals and the free ends of those terminals so that the free ends of the terminals project beyond opposite ends of the predetermined length of flexible cable when individual cable harnesses are removed from the strip of interconnected cable harnesses.

8. A method according to claim 7 wherein the step of forming weakened tear lines comprises forming lines of spaced perforations in the flexible cable with the perforations severing the conductors in the flexible cable.

9. A method according to claim 5 wherein the cable has one or more of the conductors omitted therefrom to form a longitudinally extending blank space or spaces therein, and further including removing from the strips of terminals a respective pair or pairs of terminals at a location or locations corresponding to the location or locations of the omitted conductors prior to feeding the predetermined lengths of the terminal strips into superposed relation to the cable.

10. A method according to claim 9 including longitudinally slitting the cable with terminals fastened thereto along the space or spaces formed by the omitted conductor or conductors and omitted terminals to form multiple, narrower strips of interconnected cable harnesses.

11. Apparatus for forming serially interconnected electrical cable harnesses from multi-conductor flat flexible cable, said apparatus comprising (a) cable feeding means for feeding an elongate strip of multi-conductor flat flexible cable longitudinally along a predetermined path of travel in intermittent feeding intervals so that a predetermined length of the strip of cable is fed during each feeding interval, (b) terminal feeding means operable in timed relation to said cable feeding means for feeding a pair of elongate, oppositely facing strips of terminals longitudinally along spaced apart paths of travel substantially perpendicular to said predetermined path of travel of the flexible cable in intermittent intervals such that predetermined lengths of the strips of terminals and the strip of flexible cable are in a superposed relation, and (c) terminal applicator means operable in timed relation to said cable feeding means and said terminal feeding means for fastening the terminals in the predetermined lengths of the strips of terminals to the flexible cable in electrical conductive relation to the conductors in the cable in such manner that the terminals extend across the strip of flexible cable in spaced apart rows with the terminals in adjacent rows facing in opposite directions, whereby a strip of serially interconnected cable harnesses are formed with oppositely facing terminals at opposite ends of predetermined lengths of the flat flexible cable.

12. Apparatus according to claim 11 wherein each of the strips of terminals include a continuous carrier portion extending along at least one side of the strip and a row of spaced apart, elongate terminals carried by said carrier portion and projecting laterally outwardly from said carrier portion, and wherein said terminal applicator means includes means for separating the terminals to be fastened to the flexible cable from their respective carrier portions.

13. Apparatus according to claim 12 wherein said terminal feeding means feeds the strips of terminals such that the carrier portions of the strips are on the distal sides of the pair of strips of terminals and the terminals on the adjacent sides of the pair of strips and thereby project toward each other.

14. Apparatus according to claim 13 wherein said terminal feeding means feeds the strips of terminals along paths of travel, the spacing between which is small compared to the predetermined length of the flexible cable fed by said cable feeding means during each feeding interval.

15. Apparatus for forming serially interconnected but separable electrical cable harnesses from multi-conductor flat flexible cable, said apparatus comprising (a) cable feeding means for feeding an elongate strip of multi-conductor flat flexible cable longitudinally along a predetermined path of travel in intermittent feeding intervals so that a predetermined length of the strip of cable is fed during each feeding interval, (b) terminal feeding means operable in timed relation to said cable feeding means for feeding a pair of elongate, oppositely facing strips of terminals longitudinally along spaced apart paths of travel substantially perpendicular to said predetermined path of travel of the flexible cable in intermittent intervals such that predetermined lengths of the strips of terminals and the strip of flexible cable are in a superposed relation, (c) terminal applicator means operable in timed relation to said cable feeding means and said terminal feeding means for fastening the terminals in the predetermined lengths of the strips of terminals to the flexible cable in electrical conductive relation to the conductors in the cable in such manner that the terminals extend across the strip of flexible cable in spaced apart rows with the terminals in adjacent rows facing in opposite directions, and (d) means for forming at least one weakened tear line in the strip of flexible cable between and parallel to the rows of terminals formed by the pair of oppositely facing strips of terminals, whereby a strip of serially interconnected cable harnesses are formed with oppositely facing terminals at opposite ends of predetermined lengths of the flat flexible cable.

16. Apparatus according to claim 15 wherein said means for forming at least one weakened tear line forms a pair of parallel, spaced apart weakened tear lines in the flexible cable with a weakened tear line being formed adjacent each row of terminals so that a section of flexible cable between the rows of terminals is removed when individual cable harnesses are separated from the strip of interconnected cable harnesses.

17. Apparatus according to claim 16 wherein each of the terminals is fastened to the flexible cable at one end portion thereof and has the other end portion free of securement, and wherein said means for forming weakened tear lines is located adjacent said terminal applicator means in such manner that the weakened tear lines are formed in the flexible cable between the points of fastening of the terminals in each row of terminals and the free ends of those terminals so that the free ends of the terminals project beyond opposite ends of the predetermined length of flexible cable when individual cable harnesses are removed from the strip of interconnected cable harnesses.

18. Apparatus according to claim 17 wherein said means for forming weakened tear lines includes knife means for forming lines of spaced perforations in the flexible cable, said knife means being operatively associated with said cable feeding means such that when said knife means forms the spaced perforations said knife means severs the conductors in the flexible cable.

19. Apparatus according to claim 18 wherein said means for forming weakened tear lines further comprises anvil means for supporting the predetermined length of flexible cable and rows of terminals during formation of the line of spaced perforations by said knife means;

20. Apparatus according to claim 19 wherein said knife means have substantially straight, planar cutting edges, and said anvil means supports said cable and rows of terminals such that the portions of the cable which include the conductors are supported at a slightly higher elevation than are the portions of the cable between the conductors whereby the portions of the cable which include the conductors are completely severed but the portions of the cable between the conductors are only scored or weakened.

21. Apparatus according to claim 15 wherein the cable has one or more of the conductors omitted therefrom to form a longitudinally extending blank space or spaces therein, and including means operatively associated with said terminal strip feeding means for removing from the strips of terminals a respective pair or pairs of terminals at a location or locations corresponding to the location or locations of the blank space or spaces in the cable prior to the predetermined lengths of terminal strips being fed into superposed relation to the cable.

22. Apparatus according to claim 21 including means for longitudinally slitting the cable with terminals fastened thereto along the blank space or spaces formed by omitted conductor or conductors and omitted terminals to form multiple strips of interconnected but separable cable harnesses.

23. A method of forming serially interconnected but separable harness segments from multi-conductor flat flexible cable comprising the steps of (a) feeding an elongate strip of multi-conductor flat flexible cable longitudinally along a predetermined path of travel in intermittent intervals so that a predetermined length of the strip of cable is fed during each feeding interval, (b) feeding a strip of terminals longitudinally along spaced apart paths of travel perpendicular to the path of travel of the flexible cable in intermittent intervals and in timed relation to the feeding intervals of the flexible cable so that predetermined lengths of the strips of terminals and the flexible cable are in a superposed relation, the stip of terminals each including tranversely extending, spaced apart, elongate terminals, the strip being fed in such manner that the terminals of the strip define a spaced apart, transversely extending row of terminals (c) fastening the terminals to the flexible cable in electrical conductive relation to the conductors in the cable in timed relation to the feeding intervals for the flexible cable and strip of terminals, and (d) forming at least one weakened tear line in the strip of flexible cable adjacent and parallel to the row of terminals formed by the strip of terminals, whereby a strip of serially interconnected but separable cable harness segments having terminals attached to predetermined lengths of the flexible cable is formed.

24. A method according to claim 23 wherein each of the terminals is fastened to the flexible cable at one end portion thereof and has the other end portion free of securement, and wherein the weakened tear lines are formed in the flexible cable between the points of fastening of the terminals in each row of terminals and the free ends of those terminals so that the free ends of the terminals project beyond an end of the predetermined length of flexible cable when individual cable harnesses are removed from the strip of interconnected cable harnesses.

25. A method according to claim 24 wherein the step of forming weakened tear lines comprises forming lines of spaced perforations in the flexible cable with the perforations severing the conductors in the flexible cable.

26. Apparatus for forming serially interconnected but separable electrical cable harness segments from multi-conductor flat flexible cable, said apparatus comprising (a) cable feeding means for feeding an elongate strip of multi-conductor flat flexible cable longitudinally along a predetermined path of travel in intermittent feeding intervals so that a predetermined length of the strip of cable is fed during each feeding interval, (b) terminal feeding means operable in timed relation to said cable feeding means for feeding an elongate strip of terminals longitudinally substantially perpendicular to said predetermined path of travel of the flexible cable in intermittent interval such that a predetermined length of the strip of terminals and the strip of flexible cable are in a superposed relation, (c) terminal applicator means operable in timed relation to said cable feeding means and said terminal feeding means for fastening the terminals in the predetermined lengths of the strip of terminals to the flexible cable in electrical conductive relation to the conductors in the cable in such manner that the terminals extend across the strip of flexible cable, and (d) means for forming at least one weakened tear line in the strip of flexible cable adjacent and parallel to the row of terminals, whereby a strip of serially interconnected cable harness segments including predetermined length of the flat flexible cable are formed.

* * * * *